US011255123B2

(12) United States Patent
Slobbe et al.

(10) Patent No.: US 11,255,123 B2
(45) Date of Patent: Feb. 22, 2022

(54) CONTROL MECHANISM FOR A DOUBLE PITCH BLIND AND A DOUBLE PITCH BLIND ASSEMBLY

(71) Applicant: Hunter Douglas Industries B.V., Rotterdam (NL)

(72) Inventors: Christianus Wilfred Michael Slobbe, Rotterdam (NL); Robert Jan Ponsen, Rotterdam (NL)

(73) Assignee: HUNTER DOUGLAS INDUSTRIES B.V., Rotterdam (NL)

( * ) Notice: Subject to any disclaimer, the term of this patent is extended or adjusted under 35 U.S.C. 154(b) by 405 days.

(21) Appl. No.: 16/174,818

(22) Filed: Oct. 30, 2018

(65) Prior Publication Data

US 2019/0128061 A1 May 2, 2019

(30) Foreign Application Priority Data

Oct. 31, 2017 (EP) ..... 17199445

(51) Int. Cl.
*E06B 9/307* (2006.01)
*E06B 9/322* (2006.01)
*E06B 9/24* (2006.01)

(52) U.S. Cl.
CPC ..... *E06B 9/322* (2013.01); *E06B 9/307* (2013.01); *E06B 2009/2423* (2013.01)

(58) Field of Classification Search
CPC ..... E06B 9/307; E06B 9/306; E06B 9/308; E06B 9/303
See application file for complete search history.

(56) References Cited

U.S. PATENT DOCUMENTS 4,651,794 A * 3/1987 Bytheway, Jr. ..... E06B 9/303 160/115
4,708,188 A * 11/1987 Bytheway, Jr. ..... E06B 9/303 160/174 R (Continued)

FOREIGN PATENT DOCUMENTS

AU 685736 1/1998
CN 101802339 8/2010

(Continued)

OTHER PUBLICATIONS

European Search Report and Written Opinion for European Application No. 18203172.4, dated Feb. 1, 2019 (7 pages).

(Continued)

*Primary Examiner* — Johnnie A. Shablack
(74) *Attorney, Agent, or Firm* — Dority & Manning, P.A.

(57) ABSTRACT

A control mechanism for a double pitch blind including an array of tiltable slats having a first sub-array of tiltable first slats and a second sub-array of tiltable second slats includes a first spool drive and a second spool drive, both the first spool drive and the second spool drive being configured to be rotated by a common drive shaft. The first spool drive has elongate members extendable and retractable on opposite sides of the slats and the second spool drive has elongate members extendable and retractable on opposite sides of the slats. The first and second spool drives are configured to transfer rotation of the drive shaft to spool-in and to spool-out the elongate members. The first spool drive spools by a first length, and the second spool drive spools by a second length. The first length is larger than the second length.

18 Claims, 21 Drawing Sheets

(56) References Cited

U.S. PATENT DOCUMENTS

| | | | | |
|---|---|---|---|---|
| 5,119,868 | A * | 6/1992 | Werner | E06B 9/307 160/115 |
| 5,232,037 | A * | 8/1993 | Fraser | E06B 9/307 160/115 |
| 6,076,587 | A * | 6/2000 | Pastor | E06B 9/307 160/115 |
| 6,318,439 | B1 * | 11/2001 | Matsubara | E06B 9/307 160/115 |
| 6,422,288 | B1 * | 7/2002 | Dekker | E06B 9/307 160/115 |
| 6,581,665 | B2 * | 6/2003 | Lin | E06B 9/32 160/115 |
| 6,648,048 | B2 * | 11/2003 | Lai | E06B 9/303 160/113 |
| 6,845,802 | B1 * | 1/2005 | Anderson | E06B 9/307 160/115 |
| 7,913,738 | B2 * | 3/2011 | Fraser | E06B 9/307 160/115 |
| 7,926,540 | B2 * | 4/2011 | Lai | E06B 9/303 160/176.1 R |
| RE43,475 | E * | 6/2012 | Dekker | E06B 9/307 160/115 |
| 8,267,145 | B2 * | 9/2012 | Fraser | E06B 9/322 160/115 |
| 8,485,242 | B2 * | 7/2013 | Fraser | E06B 9/307 |
| 9,217,282 | B2 | 12/2015 | Defenbaugh et al. | |
| 9,228,392 | B2 * | 1/2016 | Hermans | E06B 9/322 |
| 9,371,686 | B2 | 6/2016 | Lagarde | |
| 9,487,996 | B2 * | 11/2016 | Steenbergen | E06B 9/307 |
| 9,797,190 | B2 * | 10/2017 | Zhang | E06B 9/303 |
| 10,156,092 | B2 * | 12/2018 | Steenbergen | E06B 9/307 |
| 2005/0257900 | A1 | 11/2005 | McCarty et al. | |
| 2005/0274465 | A1 * | 12/2005 | Hsu | E06B 9/303 160/168.1 R |
| 2006/0169420 | A1 | 8/2006 | Liang | |
| 2009/0314440 | A1 * | 12/2009 | Lai | E06B 9/303 160/170 |
| 2010/0071858 | A1 * | 3/2010 | Lai | E06B 9/307 160/170 |
| 2012/0216966 | A1 | 8/2012 | Krab et al. | |

FOREIGN PATENT DOCUMENTS

| | | |
|---|---|---|
| CN | 104254660 | 12/2014 |
| CN | 104514477 | 4/2015 |
| EP | 1052365 | 11/2000 |
| WO | WO 2006/001870 | 1/2006 |
| WO | WO 2008/150789 | 12/2008 |
| WO | WO 2012/095424 | 7/2012 |
| WO | WO 2013/127867 | 9/2013 |

OTHER PUBLICATIONS

A Chinese Office Action and Search Report to Corresponding Application No. 2018112745352 dated Sep. 16, 2021. (8 pages).

* cited by examiner

PRIOR ART

PRIOR ART

PRIOR ART

PRIOR ART

PRIOR ART

PRIOR ART

PRIOR ART

PRIOR ART

PRIOR ART

PRIOR ART

PRIOR ART

PRIOR ART

CONTROL MECHANISM FOR A DOUBLE PITCH BLIND AND A DOUBLE PITCH BLIND ASSEMBLY

CROSS-REFERENCE TO RELATED APPLICATIONS

This application is based upon and claims the right of priority to EP Patent Application No. 17199445.2, filed on Oct. 31, 2017, the disclosure of which is hereby incorporated by reference herein in its entirety for all purposes.

FIELD OF THE INVENTION

The following relates to a control mechanism for a double pitch blind and a double pitch blind assembly including such a control mechanism. Such blinds have a double pitch configuration in which, in an open state, pairs of slats are located adjacent one another, leaving double pitch openings between the respective pairs, and, in a closed state, have the look of a conventional blind. In the open state, the openings between the respective pairs are approximately twice the width of the slats and, hence, approximately twice the extent of the openings of a conventional blind with slats of the same width.

BACKGROUND OF THE INVENTION

Arrangements for controlling double pitch blind assemblies are known from WO 2013/127867 and WO 2008/150789, which are incorporated by reference herein in their entirety for all purposes. These documents teach arrangements with two sets of ladder cords. Each set of ladder cords supports a respective array of slats, with the slats of one array alternating with the slats of the other array. The control mechanisms enable the respective ladder cords and, hence, the respective arrays of slats to be controlled separately to achieve the double pitch operation.

The following enables improvements and/or simplifications to these earlier arrangements.

BRIEF DESCRIPTION OF THE INVENTION

There may be provided a control mechanism for a double pitch blind as defined below in which a first spool drive may be configured to transfer rotation of a drive shaft in one direction to spool-in and so retract a respective first elongate member and to spool-out and so extend a respective second elongate member by a first length, and to transfer rotation of the drive shaft in the other, opposite, direction to spool-out and so extend the respective first elongate member and to spool-in and so retract the respective second elongate member by the first length, and, thereafter, to allow rotation of the drive shaft without transferring rotation of the drive shaft to spooling-in or spooling-out of the first and second elongate members of the first spool drive, and in which a second spool drive may be configured to transfer rotation of the drive shaft in one direction to spool-in and so retract a respective first elongate member and to spool-out and so extend a respective second elongate member by a second length, and to transfer rotation of the drive shaft in the other, opposite, direction to spool-out and so extend the respective first elongate member and to spool-in and so retract the respective second elongate member by the second length, and, thereafter, to allow rotation of the drive shaft without transferring rotation of the drive shaft to spooling-in or spooling-out of the first and second elongate members of the second spool drive. The first length is larger than the second length.

There may also be provided a double pitch blind assembly including one or more such control mechanisms.

This summary of the disclosure is given to aid understanding, and one of skill in the art will understand that each of the various aspects and features of the disclosure may advantageously be used separately in some instances, or in combination with other aspects and features of the disclosure in other instances. Accordingly, while the disclosure is presented in terms of embodiments, it should be appreciated that individual aspects of any embodiment can be claimed separately or in combination with aspects and features of that embodiment or any other embodiment.

BRIEF DESCRIPTION OF THE DRAWINGS

The following will be more clearly understood from the description, given by way of example only, with reference to the accompanying drawings, in which.

Figure 1A:
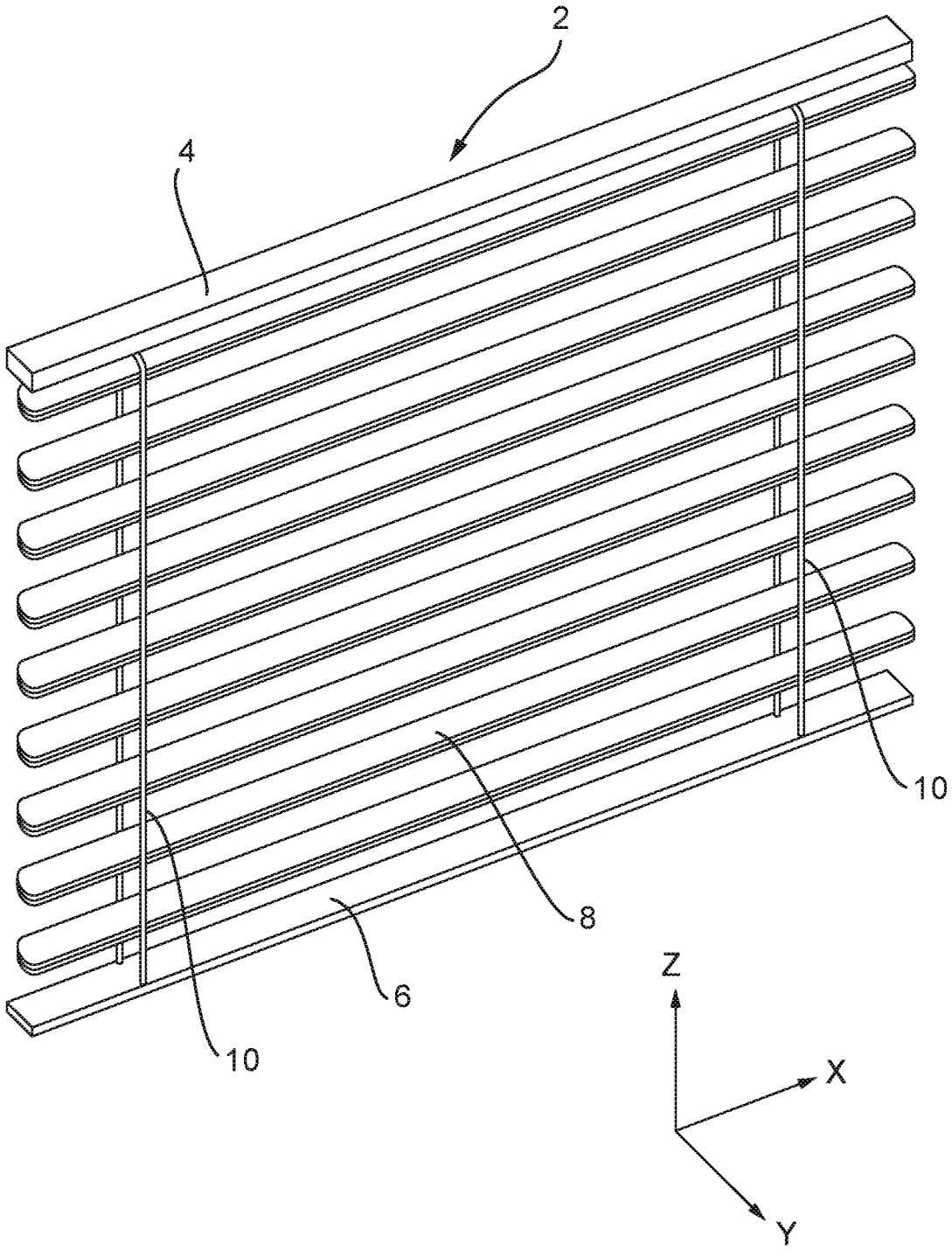
FIGS. 1(*a*) and (*b*) illustrate a double pitch blind assembly with slats respectively in an open state and a closed state.

The accompanying drawings are provided for purposes of illustration only, and the dimensions, positions, order, and relative sizes reflected in the drawings attached hereto may vary. The detailed description will be better understood in conjunction with the accompanying drawings, w Reference now will be made in detail to embodiments of the present subject matter, one or more examples of which are illustrated in the drawings. Each example is provided by way of explanation of the present subject matter, not limitation of the present subject matter. In fact, it will be apparent to those skilled in the art that various modifications and variations can be made in the present disclosure without departing from the scope or spirit of the present subject matter. For instance, features illustrated or described as part of one embodiment can be used with another embodiment to yield a still further embodiment. Thus, it is intended that the present subject matter covers such modifications and variations as come within the scope of the appended claims and their equivalents.

Even though two or more figures illustrating different embodiments may have such elements that are structurally and/or functionally similar, the presence of a same reference sign or number in otherwise different embodiments should not be understood as limiting the disclosure to the specific element nor the scope of protection of the claimed subject-matter.

DETAILED DESCRIPTION OF THE INVENTION

There may be provided a control mechanism for a double pitch blind including an array of tiltable slats having a first sub-array of tiltable first slats and a second sub-array of tiltable second slats, the first slats of the first sub-array alternating with the second slats of the second sub-array, and the first and second slats having respective lengths extending in a first direction, being stackable in a second direction perpendicular to the first direction and having respective widths extending between opposing respective edges respectively at first and second sides of the array of tiltable slats, the first and second sides of the array of tiltable slats being opposed in a third direction perpendicular to the first and second directions. The control mechanism may include a first spool drive and a second spool drive, both the first spool drive and the second spool drive being configured to be rotated by a single common drive shaft. The first spool drive may have a first elongate member extendable and retractable on the first side and a second elongate member extendable and retractable on the second side. The second spool drive may have a first elongate member extendable and retractable on the first side and a second elongate member extendable and retractable on the second side. The first elongate member of the first spool drive may be configured to operatively engage with the edges of the first slats at the first side and the second elongate member of the first spool drive may be configured to operatively engage with the edges of the second slats at the second side. The first elongate member of the second spool drive may be configured to operatively engage with the edges of the second slats at the first side and the second elongate member of the second spool drive may be configured to operatively engage with the edges of the first slats at the second side. The first spool drive may be configured to transfer rotation of the drive shaft in one direction to spool-in and so retract the respective first elongate member and to spool-out and so extend the respective second elongate member by a first length, and to transfer rotation of the drive shaft in the other, opposite, direction to spool-out and so extend the respective first elongate member and to spool-in and so retract the respective second elongate member by the first length, and, thereafter, to allow rotation of the drive shaft without transferring rotation of the drive shaft to spooling-in or spooling-out of the first and second elongate members of the first spool drive. The second spool drive may be configured to transfer rotation of the drive shaft in one direction to spool-in and so retract the respective first elongate member and to spool-out and so extend the respective second elongate member by a second length, and to transfer rotation of the drive shaft in the other, opposite, direction to spool-out and so extend the respective first elongate member and to spool-in and so retract the respective second elongate member by the second length, and, thereafter, to allow rotation of the drive shaft without transferring rotation of the drive shaft to spooling-in or spooling-out of the first and second elongate members of the second spool drive. The first length is larger than the second length.

In this way, both the first spool drive and the second spool drive may be rotated by rotation of the single common drive shaft such that relatively simple operation may be achieved. Each respective spool drive is coupled to slats from both arrays of slats, but the respective elongate members of each spool drive connect with opposite respective sides of the slats. In this way, by operating the first and second spool drives to spool-in/out by different lengths, it is possible to use the elongate members to engage with slats so as to move opposite sides of the slats by differing amounts and achieve the motion required for the double pitch blind. The spool drives may be arranged to respond to rotation of the drive shaft to spool-in/out by only a determined length and thereafter allow slip relative to rotation of the drive shaft.

Spooling-in of the first elongate members and spooling-out of the second elongate members is operable, when operably engaged with the edges of the first and second slats, to move the first and second slats from: an open state in which the first and second slats extend in the third direction and are arranged in pairs of first and second slats with each respective second slat immediately adjacent the respective first slat of the respective pair; to: a closed slate in which the first and second slats are tilted with respect to the second and third directions and overlap adjacent first and second slats on either side in the second direction.

The control mechanism may be provided with the drive shaft extending axially in the first direction. The first spool drive and second spool drive may be located at axially displaced positions along the drive shaft and be axially driven by the drive shaft.

In one arrangement, the axially displaced positions may be adjacent one another such that the first elongate member of the first spool drive is adjacent the first elongate member of the second spool drive and the second elongate member of the first spool drive is adjacent the second elongate member of the second spool drive.

In this way, the elongate members of the control mechanism may be provided close to one another. Alternatively, it may be desirable to provide the first and spool drives spaced apart along the drive shaft with the respective elongate members similarly spaced apart.

Although arrangements would be possible using gearing so that drive from the drive shaft provides different rates of spooling for the first and second spool drives respectively, it may be desirable to use the same rate of spooling for both the first spool drive and the second spool drive. In particular, with reference to angular displacement of the drive shaft, the rate of spooling-in and spooling-out for the first spool drive may be the same as the rate of spooling-in and spooling-out for the second spool drive.

As noted above, the first spool drive spools elongate members by a first length and the second spool drive spools elongate members by a second length. The first and second spool drives are configured such that, thereafter, rotation of the drive shaft causes no further spooling. This may be achieved in any convenient manner. However, the first spool drive may include a releasable first clutch configured to transmit rotation of the drive shaft respectively to spool-in and spool-out the first and second elongate members of the first spool drive and the first spool drive may be configured to release the first clutch at the end of spooling the first and second elongate members of the first spool drive by said first length. Similarly, the second spool drive may include a releasable second clutch configured to transmit rotation of the drive shaft respectively to spool-in and spool-out the first and second elongate members of the second spool drive and the second spool drive may be configured to release the second clutch at the end of spooling the first and second elongate members of the second spool drive by said second length.

This provides convenient and reliable operation.

The first spool drive may include a first stop configured to engage with the first clutch so as to release the first clutch when the first spool drive has spooled-in and spooled-out respectively the first and second elongate members of the first spool drive to reach the closed state. Similarly, the second spool drive may include a second stop configured to engage with the second clutch so as to release the second clutch when the second spool drive has spooled-in and spooled-out respectively the first and second elongate members of the second spool drive to reach the closed state.

In some arrangements, the position of the first and second stops may be adjustable so that a user and/or operator may adjust the respective first and second lengths when the control mechanism is installed in a blind assembly so as to achieve desired movement and open and closed states for the slats.

Although, functionally, the first and second spool drives each have respective first and second elongate members to extend on either side of the slats, the respective first and second elongate members may be provided as part of a respective single elongate member. In particular, first spool drive may include a first spool rotatable about an axis in the first direction and the first and second elongate members of the first spool drive may together form a single elongate member extending around the first spool. Similarly, the second spool drive may include a second spool rotatable about an axis in the first direction and the first and second elongate members of the second spool drive may together form a single elongate member extending around the second spool.

In some arrangements, the single elongate members may be provided in conjunction with respective spools.

In particular, the first spool drive may include a first spool rotatable about an axis in the first direction and the first and second elongate members of the first spool drive may together from a single elongate member extending around the first spool. Similarly, the second spool drive may include a second spool rotatable about an axis in the first direction and the first and second elongate members of the second spool drive may together form a single elongate member extending around the second spool.

With this arrangement, the first spool drive may include a first stop configured to engage with the first spool when the first spool drive has spooled-in and spooled-out respectively the first and second elongate members of the first spool drive by the first length such that the first clutch is then released. Similarly, the second spool drive may include a second stop configured to engage with the second spool when the second spool drive has spooled-in and spooled-out respectively the first and second elongate members of the second spool drive by the second length such that the second clutch is released.

This provides an efficient and convenient way of limiting the drive from the drive shaft to appropriate spooling-in and spooling-out.

As with the arrangement discussed above, the position of the first stop may be adjustable so that the first length can be adjusted, and the position of the second stop may be adjustable so that the second length may be adjusted.

The control mechanism may further include a plurality of parallel cross-rungs extending at intervals between the first elongate member of the first spool drive and the second elongate member of the second spool drive so as, together, to form a first ladder for supporting the first slats in the first sub-array. Similarly, the control mechanism may further include a plurality of parallel cross-rungs extending at intervals between the first elongate member of the second spool drive and the second elongate member of the first spool drive so as, together, to form a second ladder for supporting the second slats in the second sub-array.

In this way, it is possible to provide a control mechanism for subsequent assembly with first and second slats as required. Alternatively, the control mechanism may be provided with those first and second slats.

In an alternative arrangement, rather than the use of first and second ladders, the slats may be coupled to the elongate members. In particular, the respective edges of the first slats at the first side may be coupled to the first elongate member of the first spool drive at respective intervals and the respective edges of the first slats at the second side may be coupled to the second elongate member of the second spool drive at respective intervals. Similarly, the respective edges of the second slats at the first side may be coupled to the first elongate member of the second spool drive at respective intervals and the respective edges of the second slats at the second side may be coupled to the second elongate member of the first spool drive at respective intervals.

It will be appreciated that, by adjusting the first and second spool drives to spool-in and out with different first and second lengths, it is possible to achieve different respective opening and closing patterns of the slats. In one arrangement, the first and second lengths provided by the first and second spool drives create intervals which are double-pitch with respect to the width of the first and second slats.

The first and second elongate members may be constructed of any appropriate elongate flexible material or structure. For example, the first and second elongate members of the first and second spool drive may include tapes and/or cords.

It is also possible to provide a double pitch blind assembly including at least one of the control mechanisms. A plurality of such control mechanisms may be provided spaced apart in the first direction. In this respect, it may be desirable to provide at least one of the plurality of control mechanisms towards one end of the drive shaft and another of the plurality of control mechanisms located towards another end of the drive shaft, opposite to said one end. Of course, other arrangements are possible and it is also possible to provide additional control mechanisms at intermediate positions between the one end and the another end of the drive shaft.

These and other features and advantages of the present disclosure will be readily apparent from the following detailed description, the scope of the invention being set out in the appended claims.

Figure 1B:
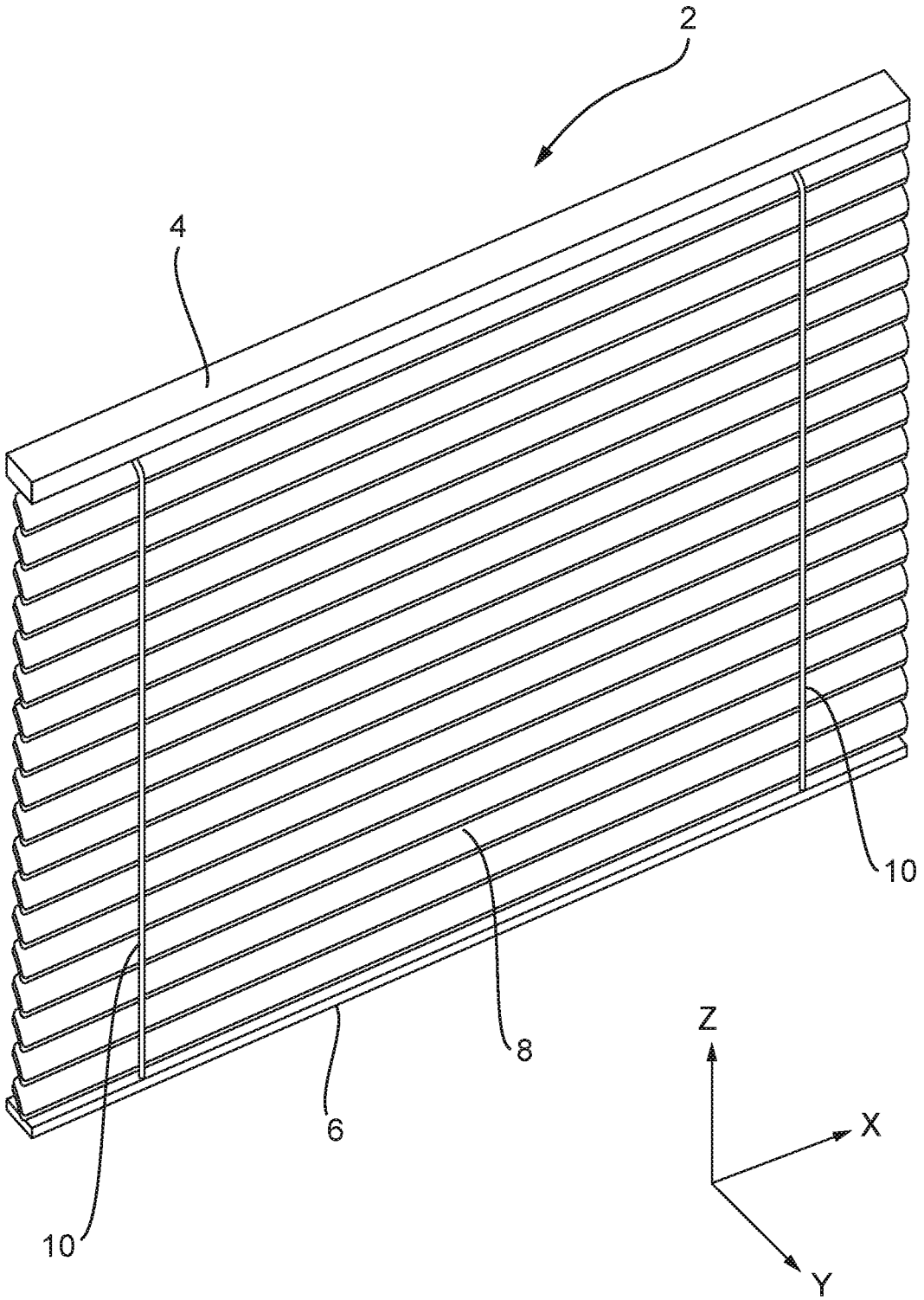

As illustrated in FIGS. 1(*a*) and (*b*), a double pitch blind assembly 2 may be provided with a head rail 4, a bottom rail 6 and a stack of slats 8 extending therebetween.

As illustrated, the blind slats 8 are arranged in a vertical array with one slat above the other and with each of the blind slats arranged generally horizontally.

Although other orientations are also possible, the illustrated arrangement is particularly advantageous when supporting the blind slats 8 under their own weight.

As illustrated, groups 10 of flexible elongate members extend down along the opposite respective edges of the blind slats 8. In particular, the elongate members are coupled to the blind slats 8 so as to support them. This coupling may be achieved in any known or convenient manner, for instance securing the elongate member directly to respective edges of the blind slats 8 or providing cross-members at least beneath each blind slat 8 so that the elongate member has the form of a ladder and the blind slats 8 rest on the cross-members.

As illustrated, elongate members are provided towards each respective end of the head rail 4 so as to support the blind slats 8 towards their respective ends. Other arrangements are also possible and additional elongate members may be provided.

The elongate members may be provided in any convenient manner, for instance as a cord, tape or chain.

Lift cords (not illustrated) may also be provided extending down from the head rail 4. The lift cords may be withdrawn into the head rail 4, for instance by winding, in order to lift the blind slats 8 up to the head rail 4 and, hence, expose the architectural opening otherwise covered by the blind. The lift cords may operate in any known or convenient manner, for instance being attached to a lowermost one of the blind slats 8 or the bottom rail 6 (as illustrated) positioned beneath the lowermost blind slat 8. The lift cords may pass through respective apertures provided in the blind slats 8 or may pass along edges of the blind slats 8.

FIG. 1(*a*) illustrates the blind 2 with the slats 8 in an open state. As illustrated, the slats 8 extend longitudinally in a first direction X and are stacked in a second direction Z. The slats 8 are not tilted, but, instead, extend substantially horizontally (in the illustrated orientation) with their widths extending in a third direction Y. The slats 8 are brought together in pairs. In this state, the space or interval left between adjacent pairs of slats 8 is approximately equal to twice the width of an individual slat 8. In a standard (non-double) pitch blind, when the slats are in an open state, they could be considered to leave a space or interval between adjacent slats of approximately the width of an individual slat. In practice, the space or interval will be slightly smaller than this width so that, in the closed state, there will be an overlap of adjacent slats. Hence, the space or interval may be as little as half the width of an individual slat. Similarly, for the double pitch blind under consideration, the space or interval will be slightly smaller than twice the width of an individual slat so that, in the closed state, there will be an overlap of adjacent slats. To provide an overlap in the closed state corresponding to the overlap of the standard pitch blind mentioned above, the space or interval may be as little as the width of an individual slat. Hence, in the open state, compared with a standard pitch blind, the space or interval provided by the double pitch blind under consideration may be 1.1, 1.2, 1.3, 1.4, 1.5, 1.6, 1.7, 1.8, 1.9 or 2 times the space or interval provided by a standard pitch blind.

FIG. 1(*b*) illustrates a closed state in which the slats 8 are tilted so as to overlap adjacent slats on either side. In this respect, it will be appreciated that the overlap need only be minimal so that the blind 2 as a whole obscures vision there through. In other words, the slats 8 together provide an arrangement with no openings extending substantially perpendicular to or through the planar form of that arrangement. The overlap can be more substantial, for example half the width of an individual slat 8 for a space or interval between adjacent pairs of slats 8 in the open state of the width of an individual slat 8.

In order to control and move the slats 8, groups 10 of elongate members extend from the head rail 4 so as to engage with and operate the slats 8. The elongate members are thus operating members which operate the slats 8 so as to tilt the slats 8 between open and closed states as discussed below. These elongate/operating members may take the form of cords, tapes or chains as mentioned above.

Figure 2:
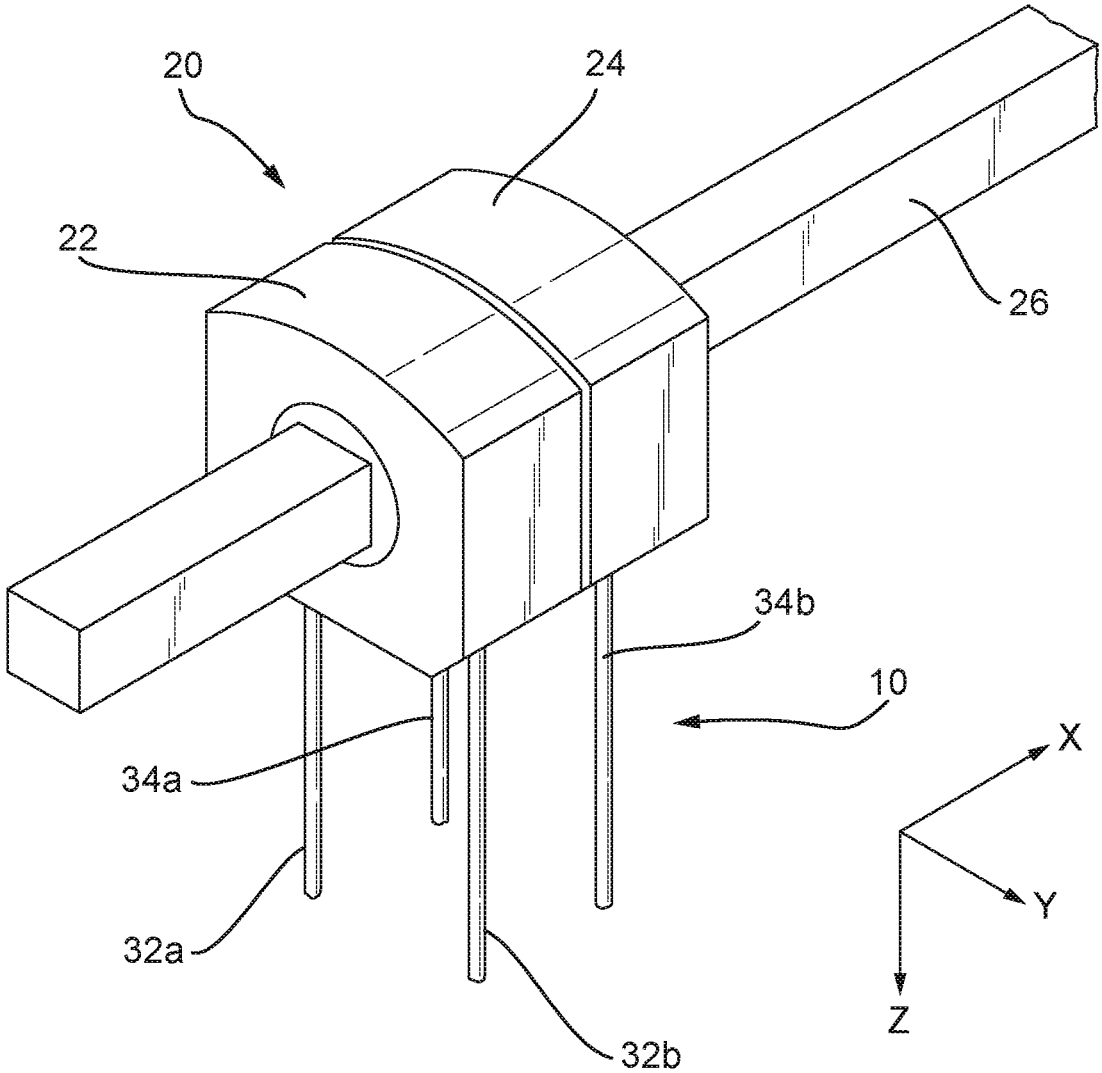
FIG. 2 illustrates first and second spool drives of a control mechanism mounted adjacent each other on a drive shaft.

Within the head rail 4, for each set of elongate members 10, there is provided a control mechanism 20 which, as illustrated in FIG. 2, includes a first spool drive 22 and a second spool drive 24. These spool drives may be constructed according to the teachings of WO 2012/095424 and/or EP 1 052 365, which are incorporated by reference herein in their entirety for all purposes.

FIGS. 7 to 11 illustrate a spool drive 1001 constructed according to the teaching of EP 1 052 365. It includes a support body 1003 which, together with a support body cover 1005, forms a housing enclosing components of a clutch mechanism 1004 for engaging and disengaging rear and front elongate members that pivotally tilt the slats 8. This spool drive 1001 according to the teaching of EP 1 052 365 can be used as any of the spool drives 22, 24 discussed below for spooling in and spooling out elongate members in the manner described in particular with reference to FIGS. 4(*a*) and (*b*). In this respect, the manner of adjusting the extent of rotation described below for pins 52 and holes 50 may be achieved as explained in EP 1 052 365 and described below with use of adjusting pin 1065 (to be described).

Figure 9:
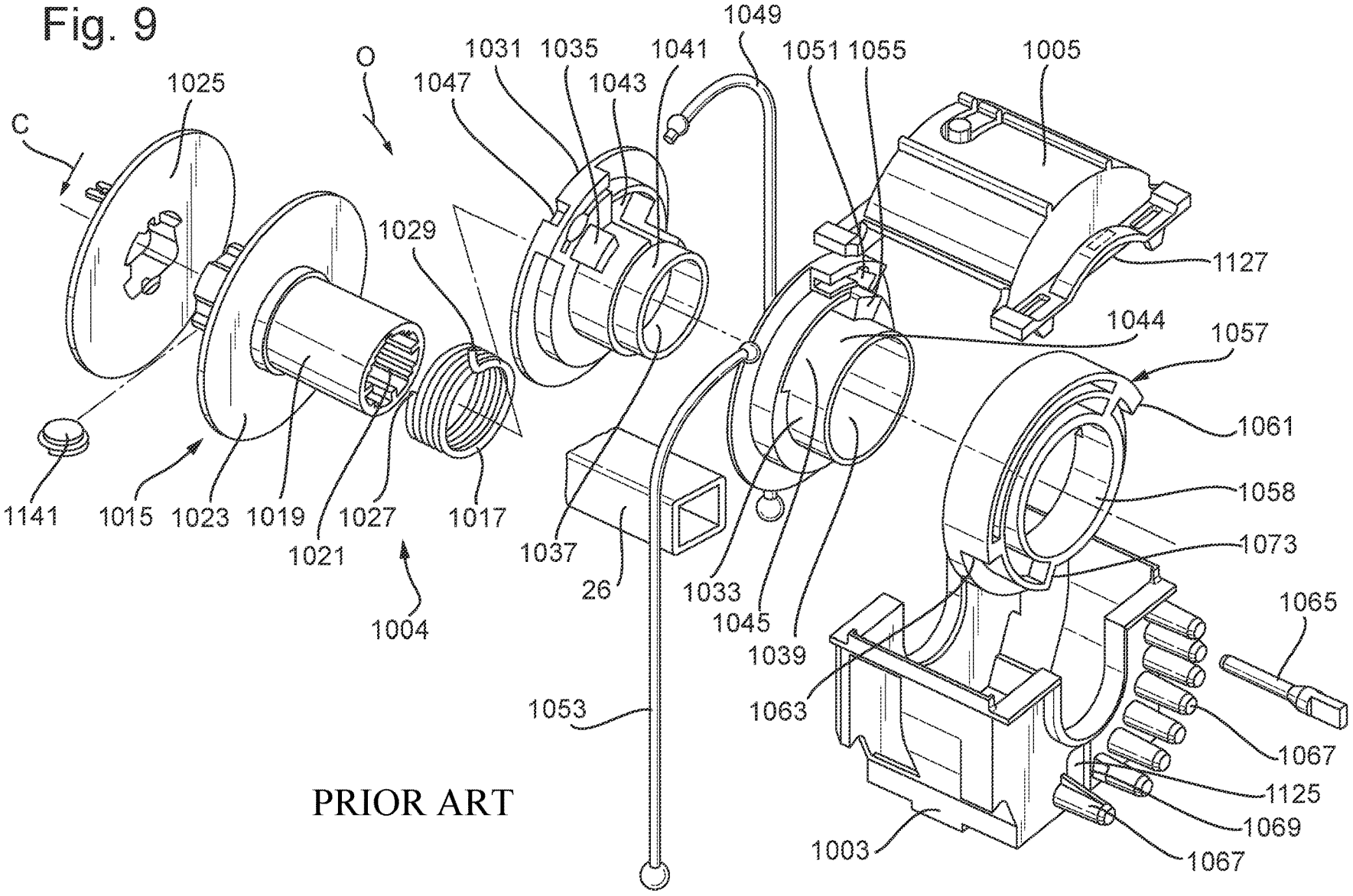
Fig. 9 PRIOR ART

The support body 1003, as best shown in FIG. 9, receives the longitudinally-extending, rotatable drive shaft 26 extending axially through it. The drive shaft 26 is driven by a conventional reversible motor or the like. The clutch mechanism 1004, within the support body 1003, is mounted for rotation by the drive shaft 26. The clutch mechanism includes: as a first element, a pulley body 1015 that rotates with the drive shaft 26; and as a second element, a first wrap spring 1017 that is releasably engaged, by friction with the pulley body 1015. The pulley body 1015 takes the form of a conventional pulley body for a spool for winding a lift tape (not shown) in order to raise the slats 8. The pulley body 1015 includes an outwardly cylindrical, rearwardly-extending first hub 1019 for accommodating the first wrap spring 1017 on its exterior surface and a central non-circular axially-extending first bore 1021 within it. The first bore 1021 has a cross-sectional shape that is complementary to the rectangular cross-section of the drive shaft 26, within it. The pulley body 1015 also includes a rearward first pulley flange 1023 and a frontal second pulley flange 1025, which are parallel and together form a spool for winding a lift tape (not shown) at the front end of the pulley body. The second pulley flange 1025 is preferably formed as a separate element which simplifies the manufacture of the pulley body 1015.

Figure 9A:
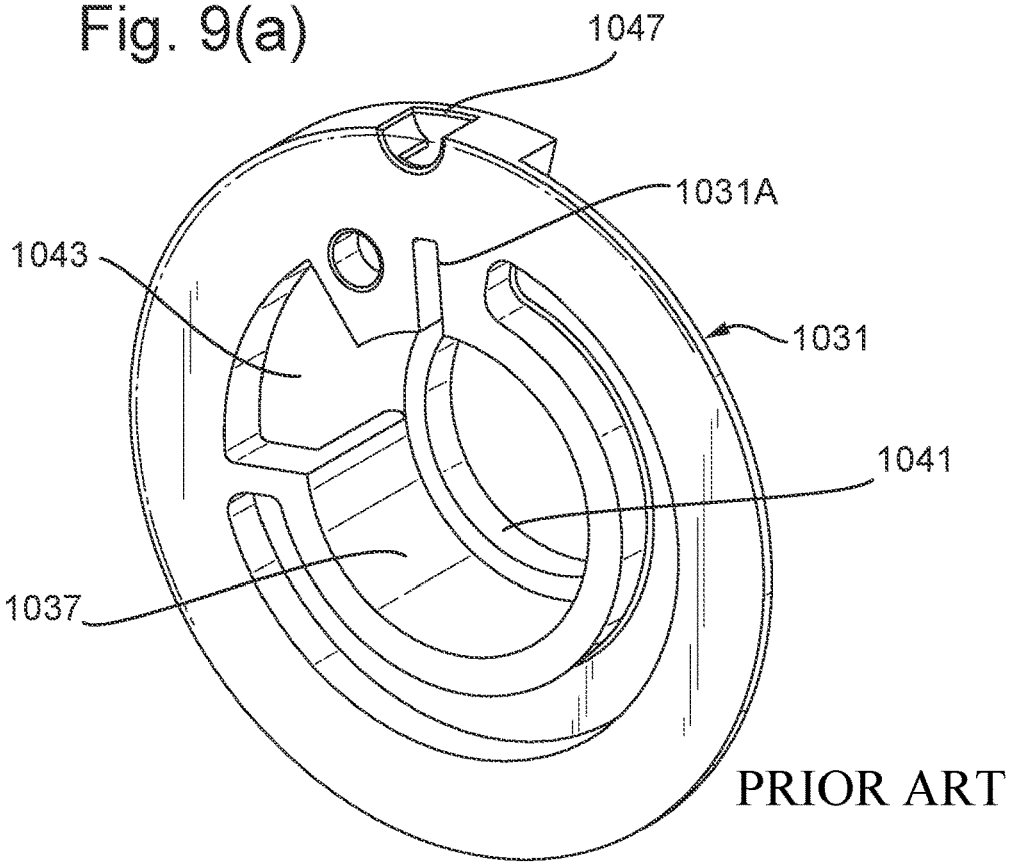
Figure 9B:
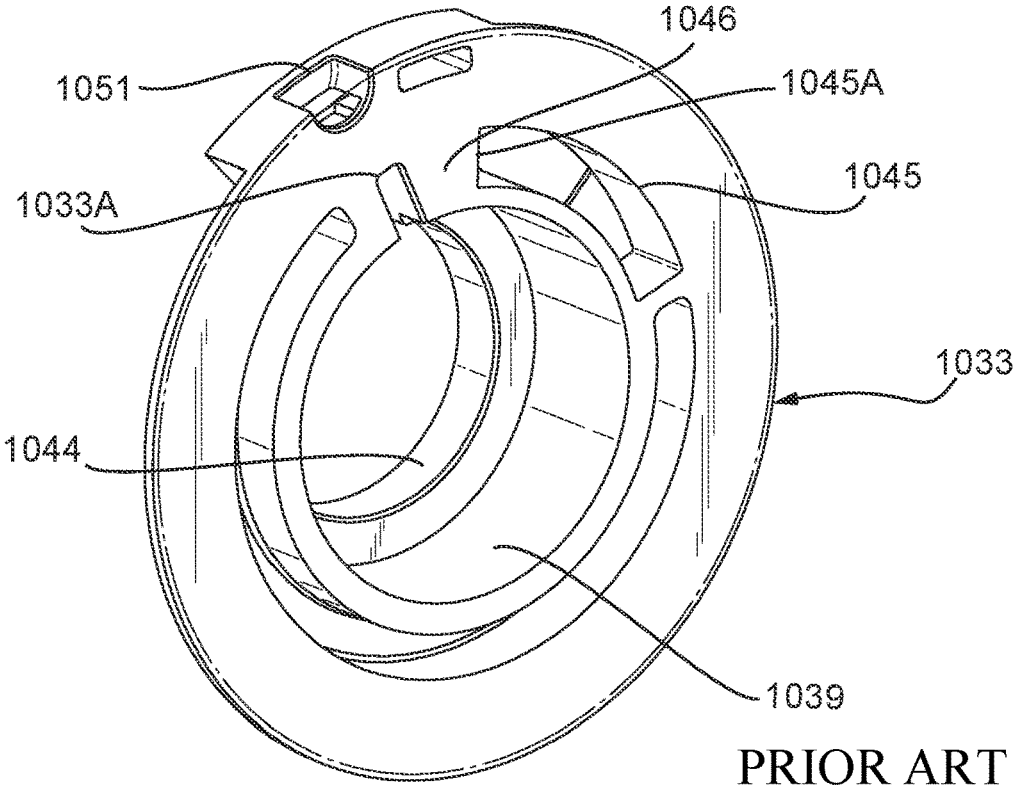
PRIOR ART Fig. 9(b)

As also seen in FIG. 9, the first wrap spring 1017 has a first radially outwardly-deflected tang or end 1027 and a second radially outwardly-deflected tang 1029. The first tang 1027 of the first wrap spring 1017 engages a first ring 1031, and its second tang 1029 engages a second ring 1033 that is adjacent to, and rearwardly of, the first ring. In this regard, the front of the first ring 1031 has a frontally-open radially-extending first groove 1031A (shown in FIG. 9A), in which the first end 1027 of the first wrap spring 1017 is accommodated in a conventional manner, and the front of the second ring 1033 has a frontally-open radially-extending second groove 1033A (shown in FIG. 9B), in which the second tang 1029 of the first wrap spring 1017 is accommodated in a conventional manner. The first ring 1031 also has a rearwardly-extending first finger 1035, spaced radially away from the drive shaft 26.

A central axial second bore 1037 through the first ring 1031 enables it to be journalled about the first hub 1019 of the rotatable pulley body 1015 while leaving an annular gap around the front part of the first hub to accommodate the first wrap spring 1017. The radially-extending first groove 1031A on the front of the first ring 1031 also opens on to the second bore 1037. The second ring 1033 has a central axial third bore 1039, by which the second ring is journalled on an outwardly cylindrical, rearwardly-extending second hub 1041 of the first ring 1031. The first ring 1031 and the front of its second hub 1041 have a radially- and axially-extending third groove 1043 to accommodate the second end 1029 of the first wrap spring 1017 when journaling the second ring 1033 on the second hub 1041. The radially-extending second groove 1033A on the front of the second ring 1033 also opens on to its third bore 1039 and the third groove 1043 of the first ring in the assembled spool drive operating mechanism.

The second ring 1033 also has an outwardly cylindrical, rearwardly-extending third hub 1044 and an axially-open radially-curved window 1045, which is spaced radially away from the drive shaft 1013 by the same distance as the first finger 1035. The front of the second ring 1033 has a surface member 1046 which covers the front of the window 1045 between the second groove 1033A of the second ring and an adjacent lateral side 1045A of the window. The first finger 1035 of the first ring 1031 extends rearwardly into the front of the window 1045, adjacent the lateral side 1045A of the window and the surface member 1046, when the first and second rings 1031 and 1033 are concentrically journalled on the first hub 1019 of the pulley body 1015 in the operating mechanism. The first finger 1035 can move, within the window 1045, laterally away from the lateral side 1045 A of the window, but is prevented by the first tang 1027 of the wrap spring 1017 from moving laterally towards the lateral side 1045A of the window.

The outer circumference of the first ring 1031 has a first cavity 1047 that is open to one lateral side for receiving and holding a tangentially-extending end portion of a first elongate member 1049 for tilting slats. The outer circumference of the second ring 1033 has a similar second cavity 1051 that is open to the opposite lateral side for receiving and holding a tangentially-extending end portion of a second elongate member 1053 for tilting slats. As a result, rotation of the first and second rings 1031,1033 together causes the elongate members 1049, 1053 to be wound in opposite directions about the first and second rings, which causes the front and rear edges of the slats 8 of the blind to move in vertically opposite directions between first and second, angular end positions (i.e., open and closed positions).

As further seen in FIG. 9, the second ring 1033 has a rearwardly-extending second finger 1055, spaced radially away from the drive shaft 1013 by the same distance as the first finger 1035. The second finger 1055 borders circumferentially on one end of the axially-open window 1045. The second finger 1055 extends into a mating radially-curved fourth groove (not shown) in the front of a timer ring 1057 that is adjacent to, and rearward of, the second ring. In this regard, the fourth groove is spaced radially away from the drive shaft 1013 by the same distance as the second finger 1055 and has the about same length and width as the second finger.

The timer ring 1057 establishes the first and second angular end positions of the slats 8. The timer ring 1057 engages and rotates coaxially together with the first and second rings 1031,1033. In this regard, the timer ring 1057 has a central axial fourth bore 1058, by which it is journalled on the third hub 1044 of the second ring 1033 and a frontally-extending third finger 1059 (shown in FIG. 9C). The third finger 1059 is spaced radially away from the drive shaft 1013 by the same distance as the first and second fingers 1035, 1055 and is circumferentially located on the front of the timer ring between the first and second fingers. The third finger 1059 extends into the rear of the axially-open window 1045 of the second ring 1033, between, and closely adjacent to, the first and second fingers 1035,1055 and rearwardly of the front surface member 1046 of the second ring when the first and second rings and the timer ring are all concentrically journalled about the first hub 1019 of the pulley body 1015. The rear of the timer ring 1057 (shown in FIG. 9C) also has a slat tilt-open, angular position stop 1061 and a slat tilt-closed, angular position stop 1063 at different circumferential locations as described below.

The support body 1003 is adapted to cooperate with the slat tilt-open and slat tilt-closed stops 1061, 1063 on the timer ring 1057. Thereby, with the cooperation of the first and second rings 1031,1033 and the first wrap spring 1017, the support body can be used to establish opposite first and second, angular tilt positions. For this purpose, an abutment or arresting pin 1065 can be inserted in a selected one of a plurality of frontally-extending holes 1067 in the rear of the support body 1003. As shown in FIG. 9, the holes 1067 are arranged in a circumferential are about the drive shaft 1013. Also for this purpose, a frontally-extending central opening 1069 is provided at the lower rear end of the support body 1003, between holes 1067, as shown in FIG. 9 and described below.

Figure 8:
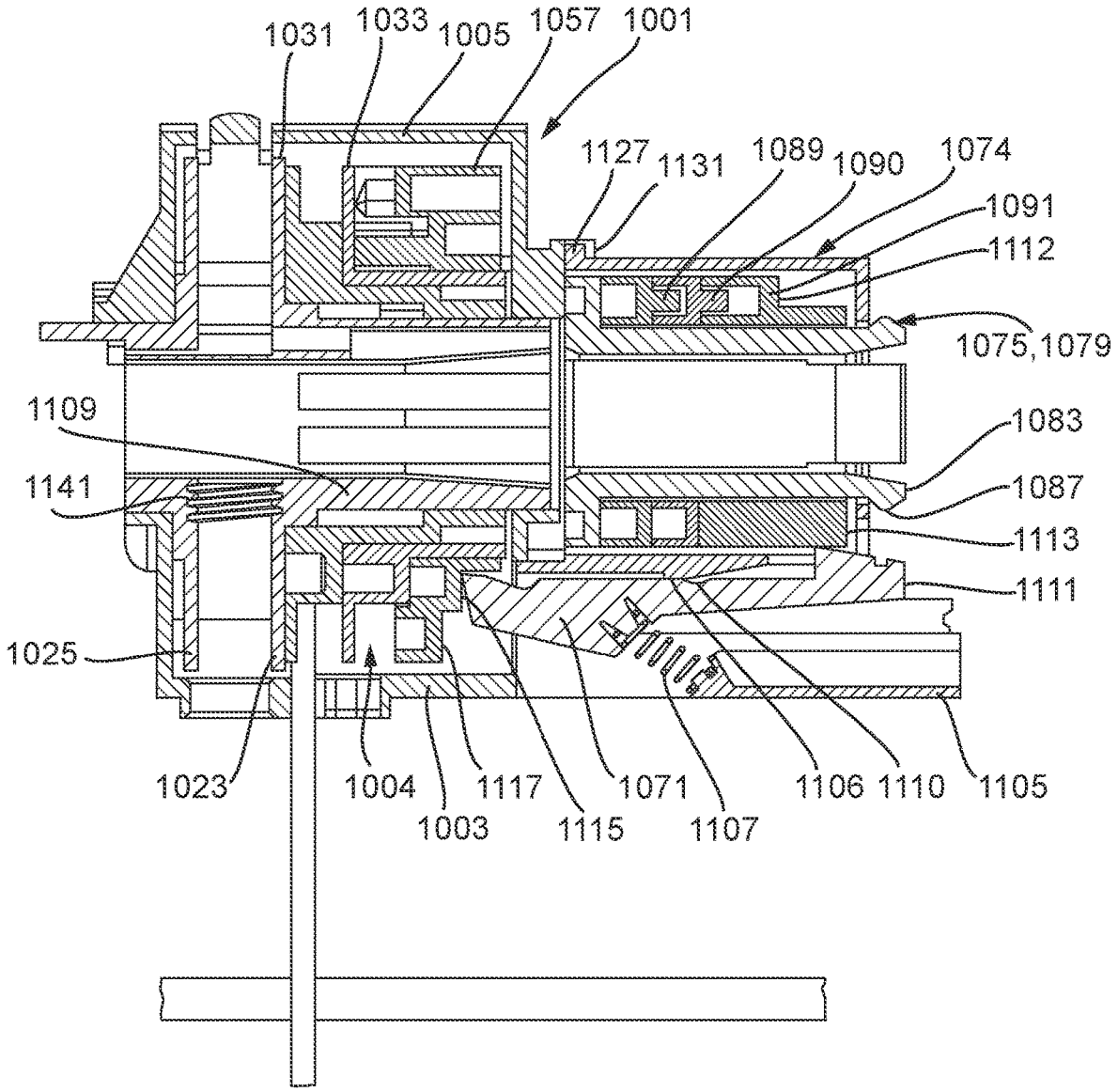
Figure 10:
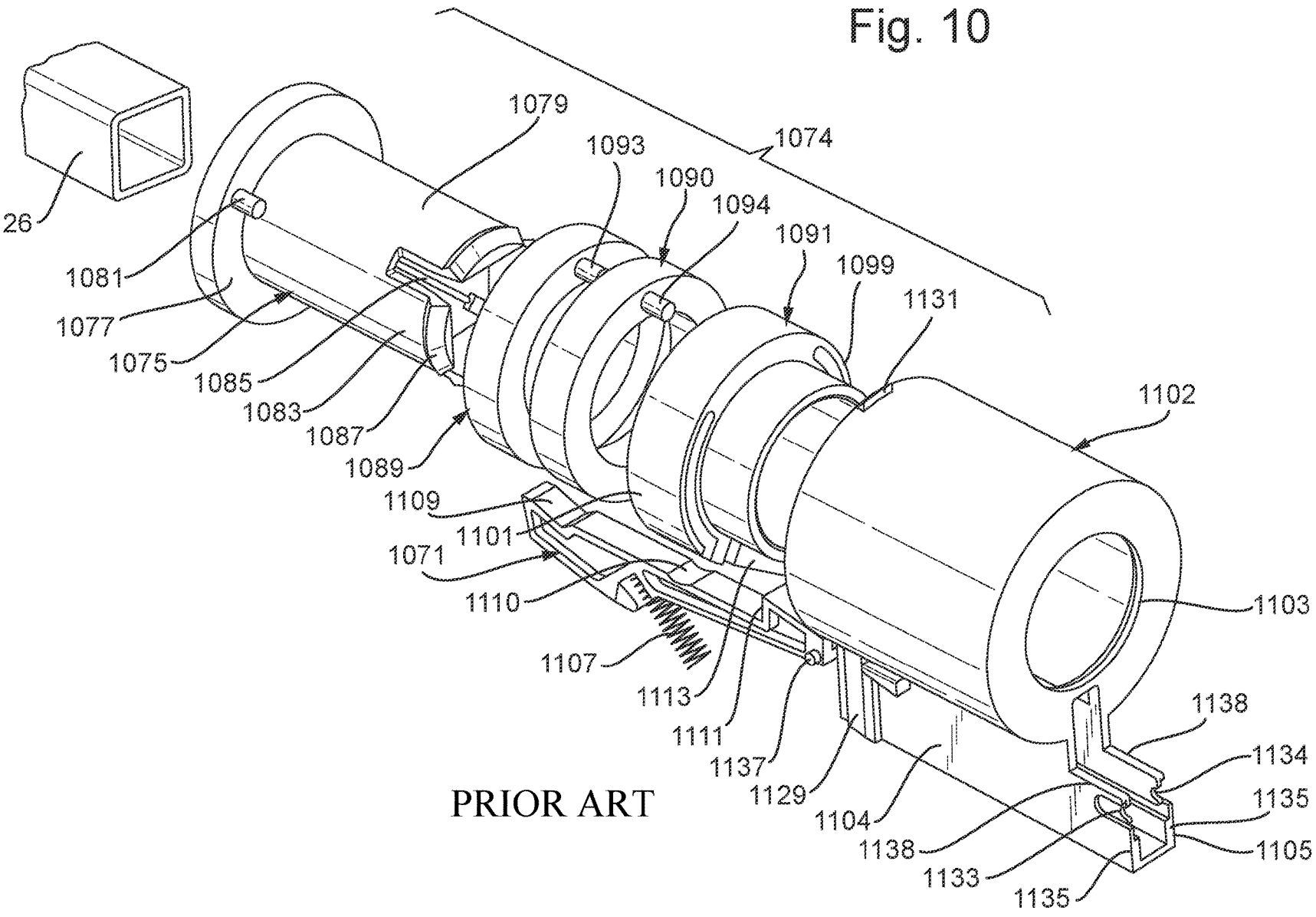
Figure 10A:
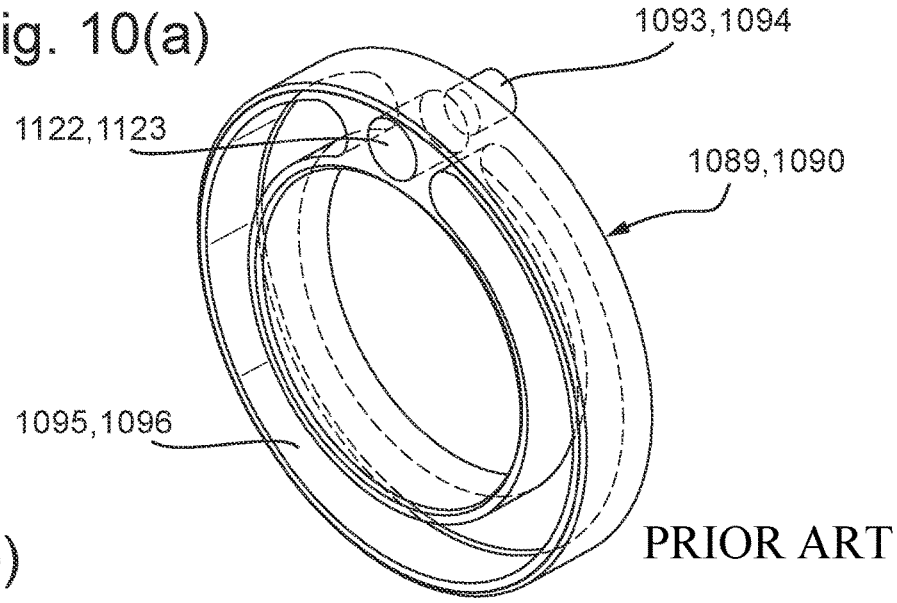
Figure 10F:
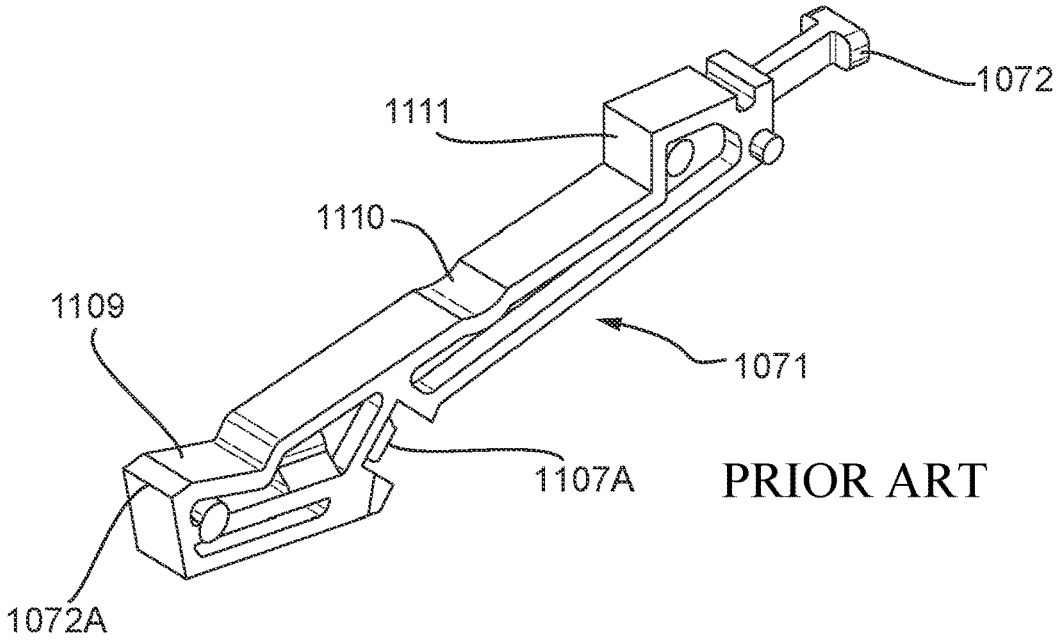
Figure 11:
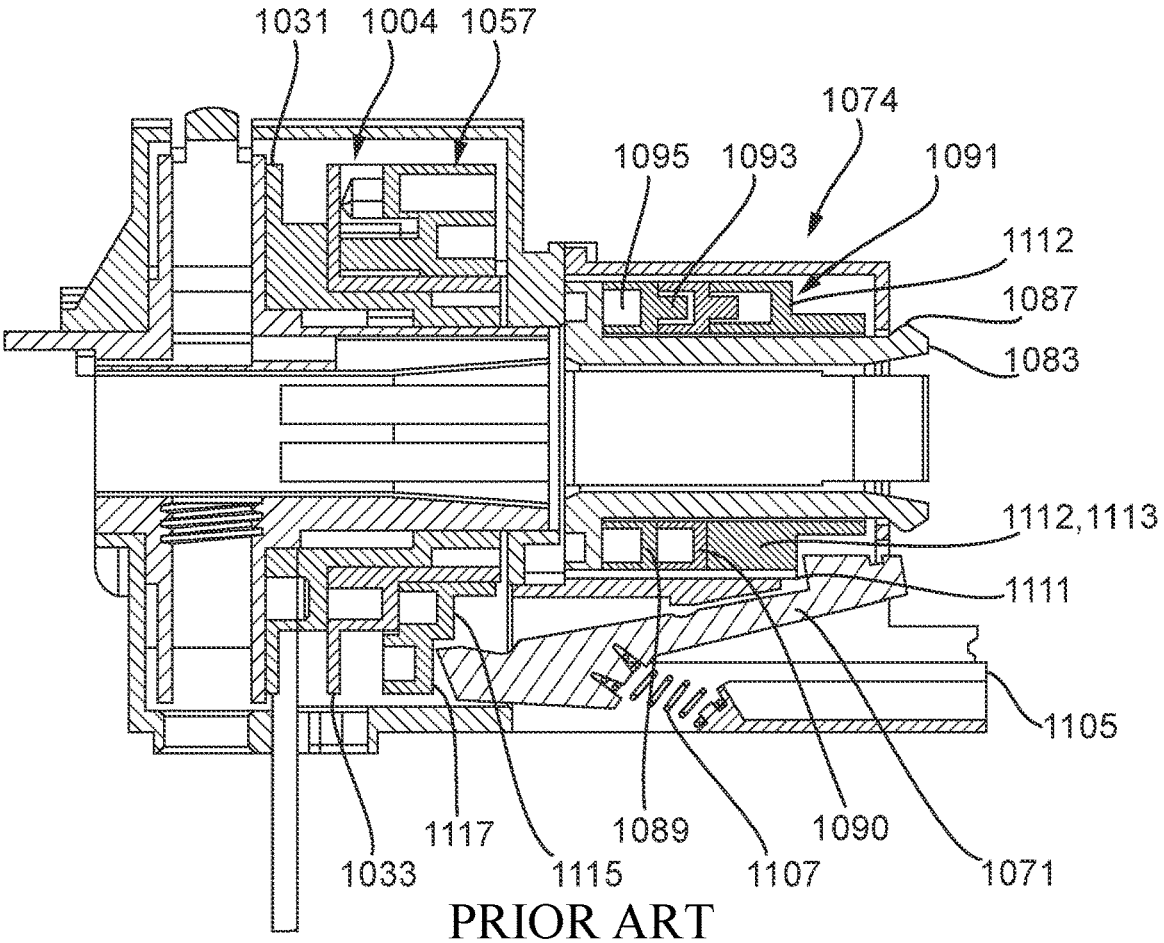
PRIOR ART Fig. 11

As shown in FIGS. 8, 10 and 11, an elongated, retractable stop lever 1071 extends frontally through the central opening 1069 of the support body 1003. As shown in FIG. 10F, the rear end 1072 of the stop lever is adapted to serve as a handle, and a portion of the front end 1072A can act, through the central opening 1069, on an intermediate slat position stop 1073 on the rear of the timer ring 1057, at a circumferential location between its slat tilt-open and slat tilt-closed stops 1061, 1063.

When the front end 1072A of the stop lever 1071 is urged to move frontally against the intermediate stop 1073, the lever stops rotation of the timer ring 1057, and thereby stops rotation of the first and second rings 1031,1033, in the direction for lowering the slats of the blind (i.e., in the direction of arrow "C" in FIG. 9). However, the first hub 1019 of the pulley body 1015 can continue to rotate in this direction with the drive shaft 1026 within the fourth bore 1058 of the timer ring 1057 while the first and second rings 1031,1033 remain on the first hub 1019 at an intermediate position of angular tilt. In addition, the first ring 1031 can continue to rotate a small distance with the first wrap spring tang 1027, relative to the second ring 1033 and the second wrap spring tang 1029, as the wrap spring continues to frictionally engage the first hub 1019. This loosens somewhat the grip of the wrap spring 1017 on the first hub 1019, so as to allow the pulley body 1015 and drive shaft 1013 to continue to rotate, even after the first and second rings 1031,1033 and the timer ring 1057 no longer rotate.

As shown in FIGS. 10 and 11, a lost motion mechanism, generally 1074, is operatively interposed between the drive shaft 26 and the stop lever 1071. The lost motion mechanism 1074 is adapted to move the stop lever 1071 axially, in and out of engagement with the intermediate stop 1073 of the timer ring 1057, only after a predetermined number of revolutions of the drive shaft 1013. The lost motion mechanism 1074 includes a driven interposer member 1075 (shown in FIG. 10E) which is directly engaged with the drive shaft 1013. The front of the interposer member 1075 has a flange 1077, connected to a rearwardly-extending, outwardly cylindrical, fourth hub 1079. A first engagement projection 1081 extends rearwardly from the rear of the flange 1077. The rear of the fourth hub 1079 has a plurality of circumferentially-spaced, rearwardly-extending, flexible tongues 1083, separated by axial slots 1085 and each carrying a detent ridge 1087 on its free rear end.

Figure 10B:
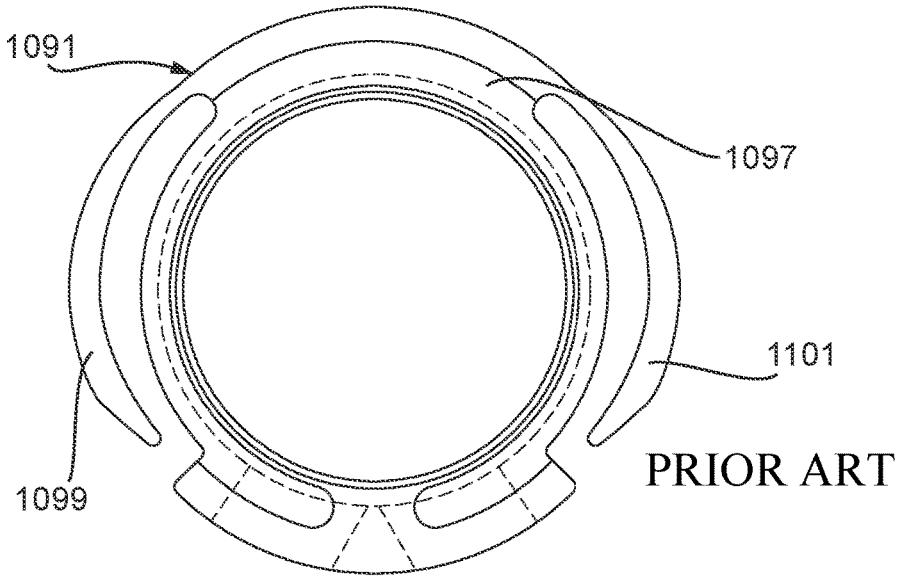
Figure 10C:
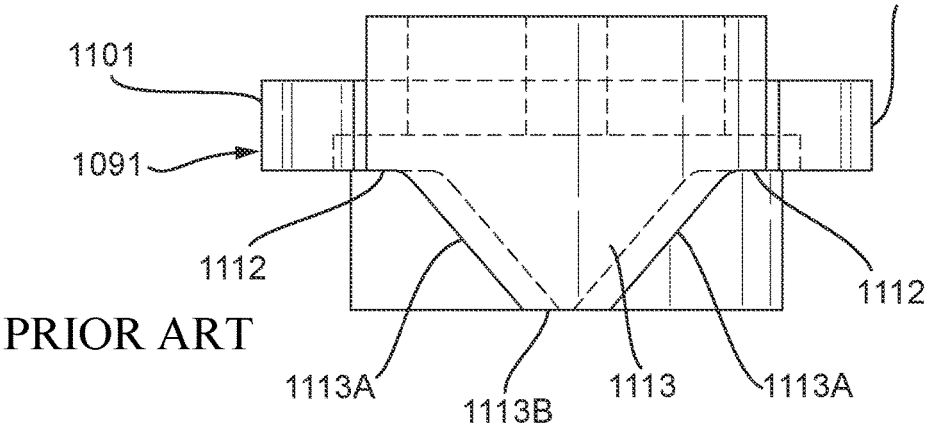
Figure 10D:
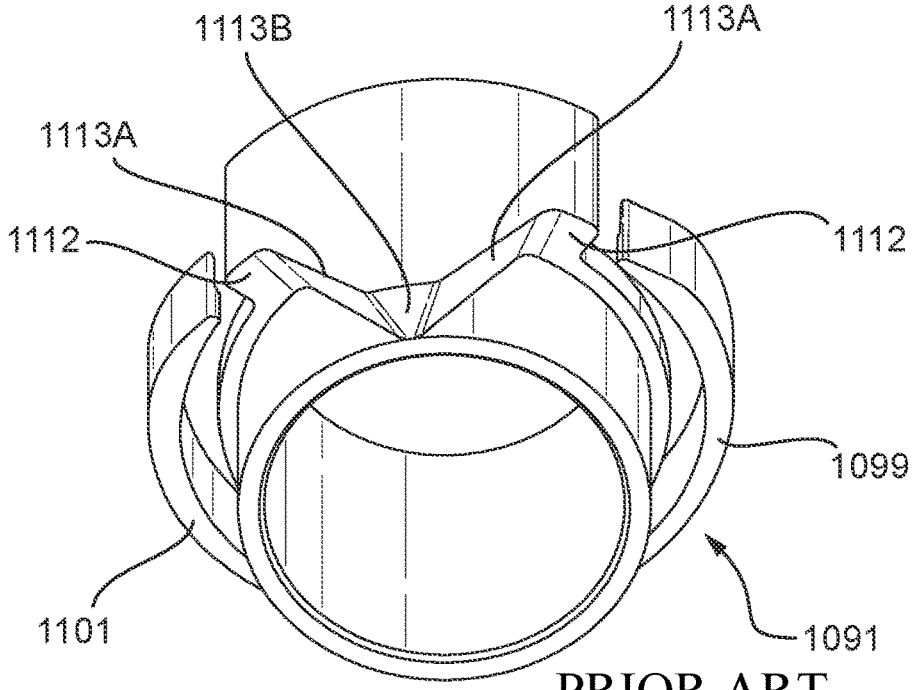
Figure 10E:
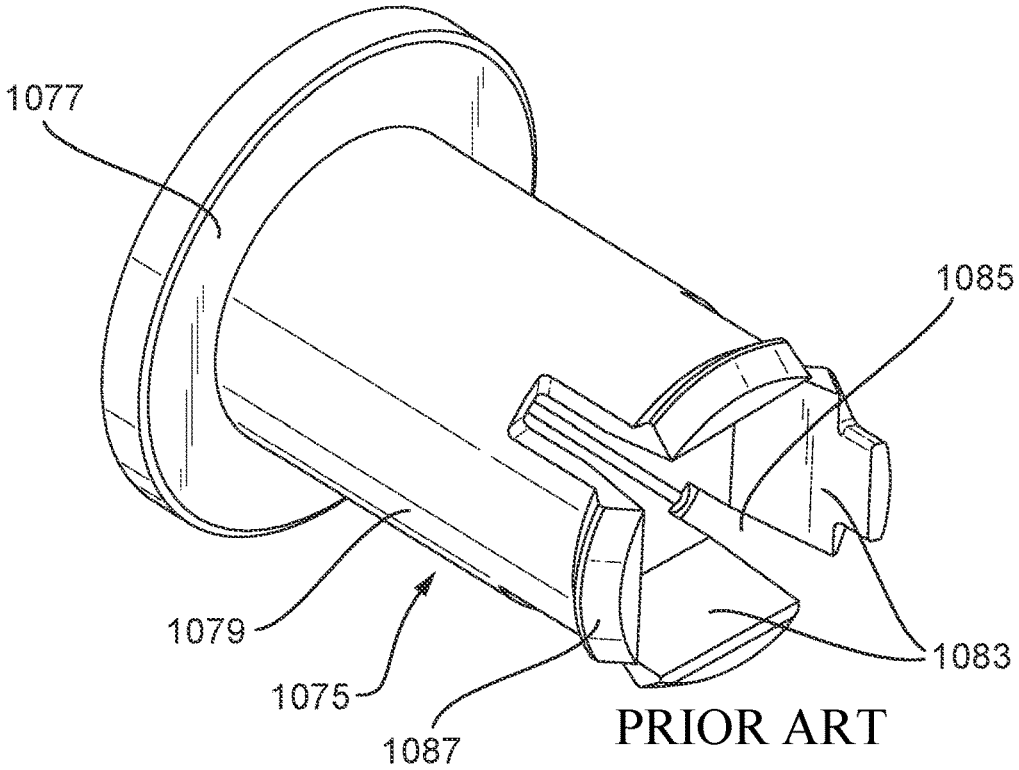
PRIOR ART Fig. 10(e)

The lost motion mechanism 1074, shown in FIG. 10, also includes two identical, adjacent, lost motion discs 1089, 1090 (shown in FIG. 10A) and an adjacent annular cam member 1091 (shown in FIGS. 10B-D). Both lost motion discs 1089,1090 and the cam member 1091 are rotatably journalled on the fourth hub 1079 of the driven interposer member 1075, while being axially retained thereon by the detent ridges 1087. The rear of each lost motion disc 1089,1090 has a rearwardly-extending second engagement projection 1093,1094, and the front of each lost motion disc (shown in FIG. 10A) has an annular first groove 1095,1096 that is frontally open. In operation, the first engagement projection 1081 of the interposer member 1075 engages the first groove 1095 of the adjacent lost motion disc 1089, and the second engagement projection 1093 of the adjacent lost motion disc 1089 thereafter engages the first groove 1096 of the other lost motion disc 1090. The front of the cam member 1091 (shown in FIG. 10B) is also provided with an annular second groove 1097 which is open frontally and engages the second engagement projection 1094 of the adjacent disc 1090. Preferably, the annular extent of each annular groove 1095,1097 is about 300° to provide a lost motion of approximately 9000 of revolution of the drive shaft 26, but the grooves can have smaller or greater annular extents to provide less or more lost motion.

Laterally opposite sides of the cam member 1091 have outwardly biased circumferential brake segments 1099 and 1101 which frictionally engage an inner cylindrical surface of a generally cylindrical housing 1102 for the lost motion mechanism 1074. The rear of the housing 1102 has a circular hole 1103, the edge of which is adapted to engage the detent ridges 1087 on the rear of the flexible tongues 1083 of the fourth hub 1079 of the interposer member 1075 when the rear of the fourth hub, carrying the journalled lost motion discs 1089,1090 and cam member 1091, is urged rearwardly through the hole 1103 to assemble the lost motion mechanism 1074.

At the bottom of the housing 1102 is an axially-extending channel-shaped extension 1104 which accommodates the stop lever 1071. A bottom portion 1105 of the extension 1104 extends rearwardly of the housing 1102. On the bottom surface of the housing 1102, within the extension 1104, is a laterally- and downwardly-extending pivot 1106. As shown in FIGS. 8, 10 and 11, the bottom of an upwardly- and frontally-inclined spring 1107 is rearwardly and upwardly biased against the front of an upstanding projection (not shown) on the bottom of the extension 1104 of the housing 1102. Front portions of the spring 1107 enclose a rearwardly-extending projection 1107A on the bottom of the stop lever 1071, so that the front of the spring biases the stop lever upwardly and frontally, towards the timer ring 1057. As a result: a front stepped-end portion 1109 of the stop lever 1071 is urged frontally and upwardly against the rear of the timer ring 1057; a laterally-extending shallow groove 1110 atop a middle portion of the stop lever is urged upwardly and frontally against the pivot 1106; and a rear stepped-end portion 1111 of the stop lever is urged frontally and upwardly through a longitudinally-extending opening (not shown) in the bottom of the housing 1102 and against the rear of the cam member 1091.

The rear of the cam member 1091 (shown in FIGS. 10C-D) has a rearwardly-facing circumferential cam surface 1112 which includes the rear surfaces of its brake segments 1099,1101. The cam member 1091 has, between its brake segments 1099, 1101, a rearwardly-extending projection 1113 on its cam surface 1112. The projection 1113 has a pair of laterally opposite sides 1113A that converge somewhat radially inwardly of the cam member 91 (as shown by phantom lines in FIG. 10C) and that also converge rearwardly towards a radially-extending flat rear side 1113B. As a result of rotation of the cam member 1091, the upwardly-extending rear stepped portion 1111 of the stop lever 1071 follows the cam surface 1112 around the rear of the cam member until the rear portion 1111 comes to the projection 1113. As the rear portion 1111 then continues to follow the cam surface 1112, the rear portion is moved rearwardly by the sides 1113A of the projection 1113 until the rear portion reaches the flat rear side 113B of the projection. This causes the front portion 1109 of the stop lever 1071 also to move rearwardly, away from the timer ring 1057 (i.e., in a direction away from the position shown in FIG. 7 and towards the position shown in FIG. 8).

Figure 9C:
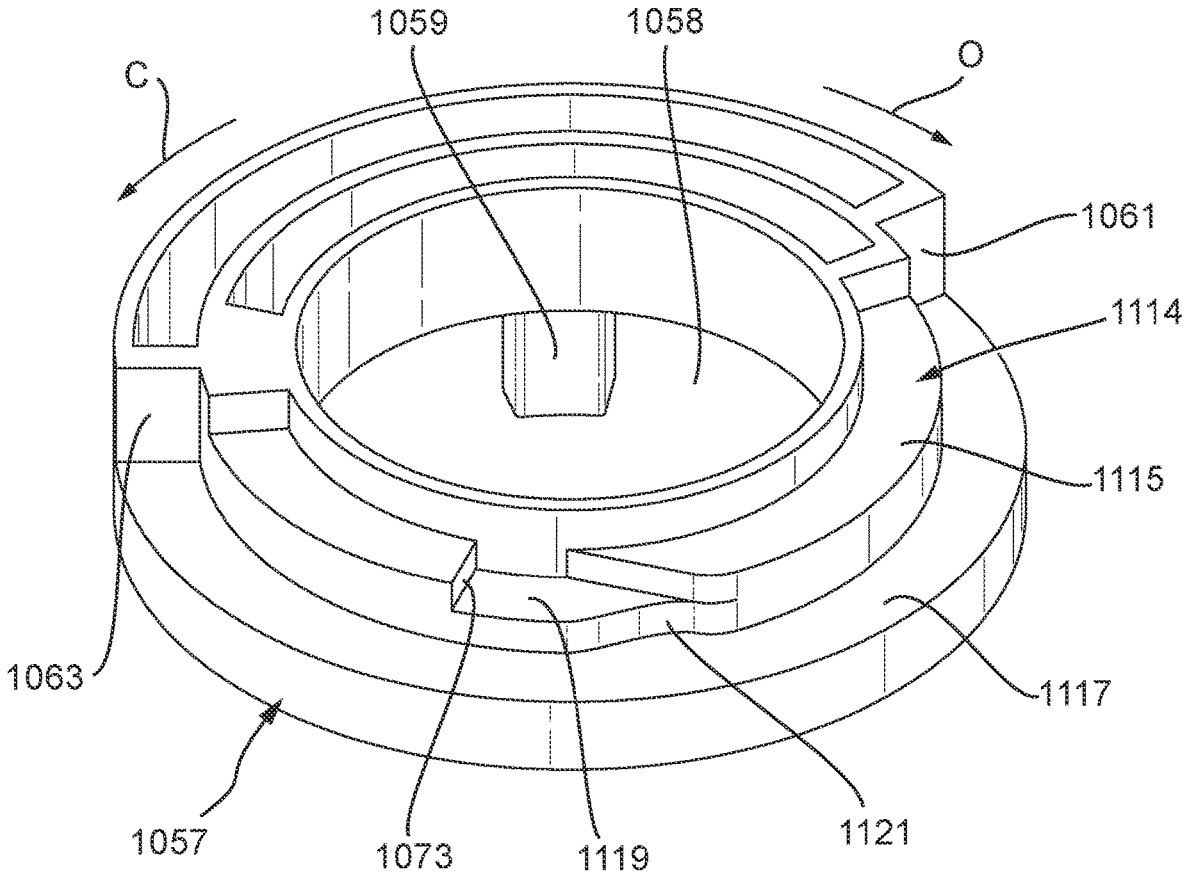

Movement of the stop lever 1071 is further guided by a stepped guide track 1114 on the rear of the timer ring 1057 as best shown in FIG. 9C. The stepped guide track 1114 is generally formed by a rearwardly-facing, radially inner, raised annular track 1115 and a rearwardly-facing, radially outer, annular track 1117, in front of the inner track 1115. Each track 1115, 1117 extends circumferentially between the slat-open and slat-closed angular position stops 1061, 1063 on the rear of the timer ring 1057. The intermediate stop 1073 is formed as part of a recess 1119 in the inner track 1115. The recess 1119, in one rotational direction of the timer ring 1057, is bordered by the intermediate stop 1073, and in the opposite direction of rotation, it is bordered by an inclined ramp surface 1121 leading to the outer track 1117.

With the stop lever 1071 in the position of FIG. 8, its front portion 1109 is frontally biased by the spring 1107 against the inner track 1115 of the timer ring 1057. In this position, if the direction of rotation of the drive shaft 1013 is changed from a direction for raising the slats 11 (i.e., the direction of arrow "O" in FIGS. 9 and 9C) to a direction for lowering the slats (i.e., the direction of arrow "C" in FIGS. 9 and 9C), the pulley body 1015 rotates with the drive shaft, causing: the first % rap spring 1017 to rotate with the pulley body; the first ring 1031 and its first finger 1035 and the second ring 1033 and its second finger 1055 to rotate with the first wrap spring; the first slat tilting cord 1049 to be wrapped about the circumference of the first ring 1031 and the second slat tilting cord 1053 to be unwrapped from about the circumference of the second ring 1033; and thereby one elongate member to move upwardly and the other elongate member to move downwardly. Such rotation of the second finger 1055 of the second ring 1033 also causes: the timer ring 1057 (which had been at rest against the slat-open angular position stop 1061) and its third finger 1059 to rotate with the second finger; and the front portion 1109 of the stop lever 1071 to move along the inner track 1115 of the timer ring 1057 until the front portion 1109 reaches, and is pushed frontally and upwardly by the spring 1107 into, the recess 1119 where the front portion finally abuts against the intermediate stop 1073. Then, such rotation of the timer ring 1057 and first and second rings 1031,1033 will be stopped by the stop lever 1071, causing the vertical movement of the elongate members to stop. Thereby, the slats will not tilt further.

If the direction of rotation of the drive shaft 1013 is then changed again (i.e., in the direction of arrow "O" in FIGS. 9 and 9C), a small amount of rotation of the rings 1031, 1033,1057 with the drive shaft causes the front portion 1109 of the stop lever 1071 to move away from engagement with the intermediate stop 1073 of the timer ring 1057, and then frontally and downwardly out of its recess 1119, via its inclined ramp 1121, onto its outer track 1117. In this position of the stop lever 1071, shown in FIG. 9, the timer ring 1057 and its operatively connected, first and second rings 1031, 1033 and first wrap spring 1117 can be rotated further by the drive shaft 1113 in either direction (i.e., in the direction of arrow "O" or arrow "C" in FIGS. 9 and 9C) between the timer ring's slat-open and slat-closed angular position stops 1061, 1063. In this regard, each angular position stop 1061,1063 will rotate with the timer ring 1057 about the drive shaft 1013 until the angular rotation of the stop causes it to hit the abutment pin 1065, inserted in one of the holes 1067 in the support body 1003, on either side of the centrally-positioned stop lever 1071.

When an angular position stop 1061, 1063 hits the abutment pin 1065 is the moment in the tilting of the slats when they at maximum or minimum tilt. Thereafter, further rotation of the drive shaft 26 can be used to either open or close the blind but not to further tilt-open or tilt-close the slats Further rotation of the drive shaft 26 will also cause rotation of the interposer member 1075, lost motion discs 1089,1090 and cam member 1091, with its cam surface 1112 and rearwardly-extending projection 1113. This will cause the rear portion 1111 of the stop lever 1071, following the cam surface 1112, to move rearwardly along the sides 1113A of its projection 1113 and, in turn, cause the front portion 1109 of the stop lever 1071 also to move rearwardly from the outer ring 1117 of the timer ring 1057 to its inner ring 1115 (i.e., in a direction away from the position shown in FIG. 11 and towards the position shown in FIG. 8).

The function of the lost motion mechanism 1074 is to delay the repositioning or resetting of the stop lever 1071 into the position of FIG. 8 (i.e., engaging the inner track 1115 of the timer ring 1057) until after a predetermined number of rotations of the drive shaft 1113 have occurred after reversing its direction of rotation. As explained above, each of the engagement projections 1081, 1093,1094 of the interposer member 1075 and lost motion discs 1089,1090 is engaged in an annular groove 1095,1096,1097 of an adjacent disc 1089,1090 or cam member 1091 of the lost motion mechanism. Each engagement projection 1081,1093,1094 will not rotate its neighboring lost motion disc or cam member until the former engages an end of any of the annular grooves 1095,1096,1097 of the latter. In the lost motion mechanism of FIG. 10, this will result in well over two, but less than three, full revolutions of lost motion delay before the cam member 1091, rotating in one direction due to rotation of the interposer member 1075, is caused to rotate in the opposite direction by a change in the direction of rotation of the interposer member.

Since resetting the stop lever 1071 into the inner track 1115 of the timer ring 1057 results in its eventually encountering the intermediate stop 1073, this could produce an undesirable effect upon reverse rotation of the drive shaft 1013 when the angular orientation of the slats is being moved back and forth—without wanting to raise the blind (which would occur if the reverse rotation from a slat-closed position continues too far). For this reason, a lost motion of two or more revolutions is preferably provided which generally ensures that the operating mechanism 1001 can stay in a full-tilt mode. Less lost motion or none could be provided in one or more of the lost motion discs 1089,1090 and cam member 1091 of the lost motion mechanism 1074 by respectively: shortening the angular length or extent of one or more of their annular grooves 1095,1096,1097; or providing a hole 1122,1123 in the front of one or both lost motion discs (as shown in FIG. 10A) and/or a like hole (not shown) in the front of the cam member 1091, in which hole(s) the mating engagement projections 1081,1093,1094 could be inserted. In this way, the manufacturer or the owner of the blind can modify its operating mechanism to have just the amount of lost motion appropriate to the blind.

Figure 7:
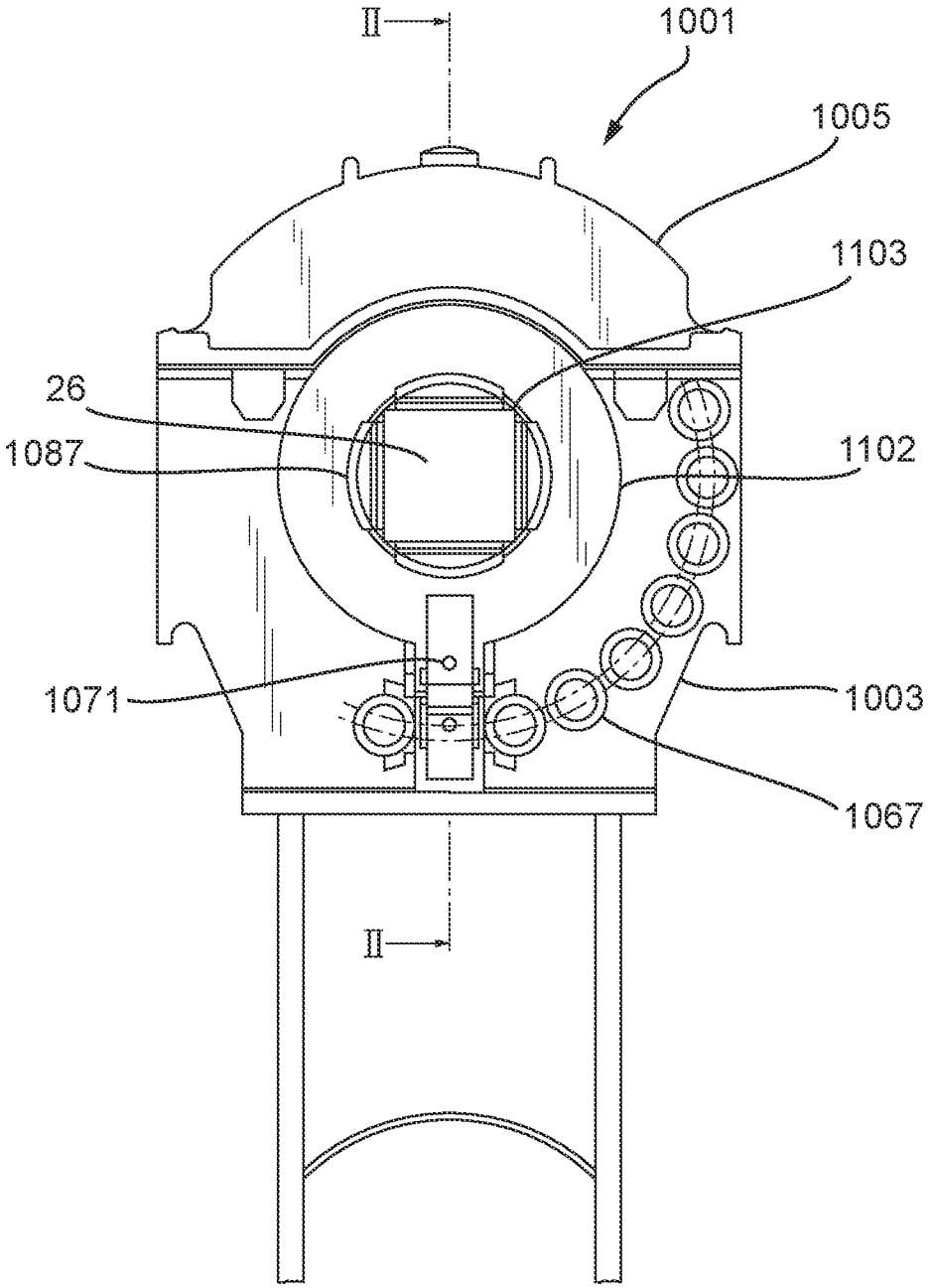
FIGS. 7 to 11 illustrate an example of a known spool drive mechanism.

As shown in FIGS. 7, 8 and 11, the rectangular drive shaft 26 passes through the center of the assembled operating mechanism 1001 and its clutch mechanism 1004 and lost motion mechanism 1074 within its support body 1003. In order to assemble the operating mechanism, the support body 1003 has: a receiving recess 1125 between its lowermost axially-extending holes 1067 and its central opening 1069; and a cavity 1127 in its cover 1005 as shown in FIG. 9. As shown in FIG. 10, ridges 1129 on the bottom of the housing 1102 for the lost motion mechanism 1074 can be snap-fit in the receiving recess 1125, and a detent 1131, on top of the housing 1102, can be snap-fit in the cavity 1127.

From FIG. 10, it is also seen that the extension 1104 of the housing 1102 has rearwardly-open recesses 1133,1134 in the laterally opposite rear vertical walls 1135 of its bottom portion 1105.

The recesses 1133, 1134 are adapted to temporarily hold laterally-extending pins 1137 on laterally opposite sides of the rear portion 1111 of the stop lever 1071 when the housing 1102 is to be attached to the support body 1003 and clutch mechanism 1004, shown in FIG. 9. After assembly, the pins 1137 should be moved out of the recesses 1133,1134 and upwardly, so that the pins can then freely move axially on smooth horizontal surfaces 1138 on top of the bottom portion 1105 of the extension 1104, between its rear vertical walls 1135 and the rear of the housing 1102, and thereby allow free axial movement of the stop lever 1071 within the extension 1104.

As also seen from FIGS. 8, 9 and 11, a screw thread 1139 is provided in the spool 1140 of the pulley body 1015 for rotatably receiving an adjustment screw plug 1141. Preferably, the width of the screw plug 1141 equals the axial distance between the pulley flanges 1023,1025. By screwing or unscrewing the plug 1141 from the spool 1140, the diameter of the spool for winding the lift tape (not shown) can be changed. The spool 1140 can, thereby, be adjusted to accommodate differences in length of the lifting tape. This can be used for fine tuning the level of the bottom rail of the blind 1012, when installing it, or to compensate for changes in the length of the lift tape over time.

In FIG. 9, the use of only a single abutment pin 1065 is shown, whereas two of them may be used to establish the rotational limits of the slat-open and slat-closed angular position stops 1061, 1063 of the timer ring 1057. The slat-closed stop for obtaining full closure is preferably provided as an integral fixed stop or abutment formation on the inside of the support body 1003. The slat-open stop can, likewise, be provided as a fixed stop on the support body 1003. However, it is preferred that the slat-open stop be in the form of the abutment pin 1065 which can be selectively inserted in any one of the holes 1067 of the semi-circular array of holes in the rear of the support body 1003. This adjustable full-open stop allows one type of operating mechanism to be used in a number of different ways.

It will be appreciated that other similar spool drive arrangements can be used without the timer function as explained above. It is sufficient for the control mechanism described herein to provide a spool drive which transfers rotation to spooling-in/out by a limited extent and then allows relative slipping.

Figure 12:
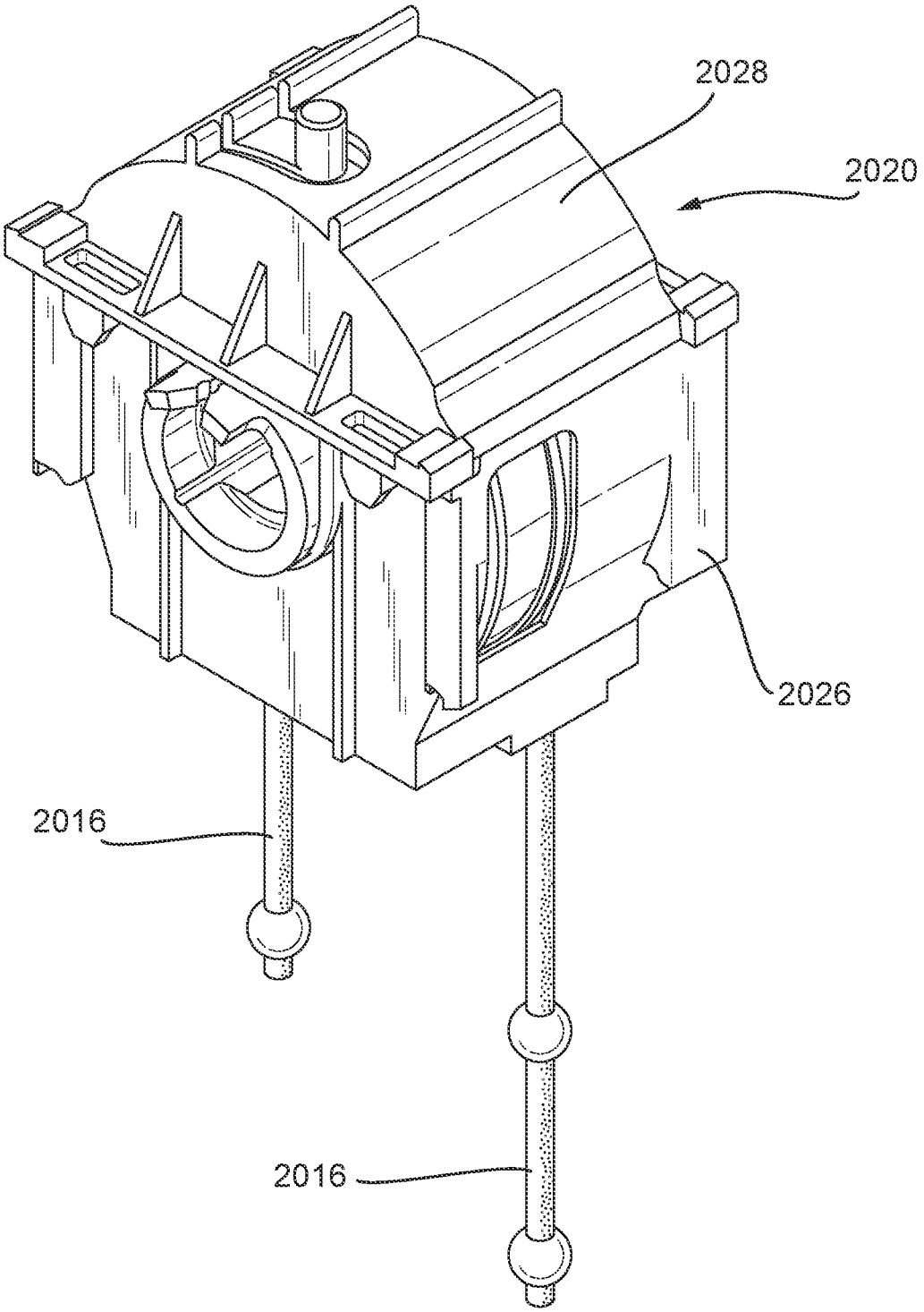
FIGS. 12 to 14 illustrate an alternative example of a known spool drive mechanism.
Figure 13:
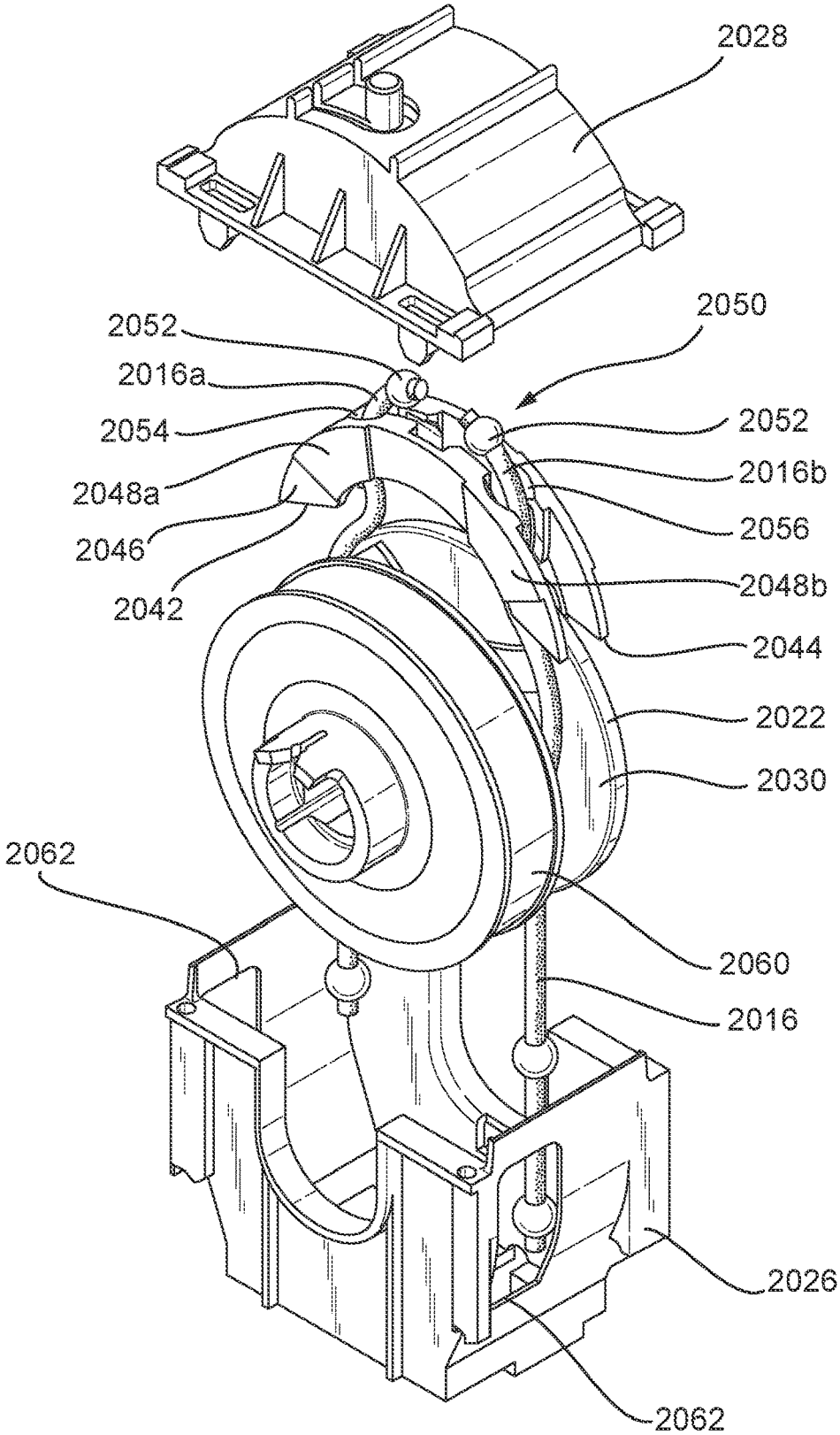

FIG. 12 illustrates a spool drive according to the teaching of WO 2012/095424, and FIG. 13 provides an exploded value of the components of the tilt controller of FIG. 12.

As illustrated, the spool drive has a tilt controller 2020 which includes a housing formed from a lower portion 2026 and an upper portion 2028, which are secured together to define an internal cavity within which a tape spool 2022 is housed.

The tape spool 2022 has an axis of rotation about which it is rotatable and has an outer circumference within which is formed a tapered groove 2030. As illustrated, the tapered groove extends around the entire circumference of this tape spool 2022 and extends radially inwardly towards the axis of rotation.

Figure 14:
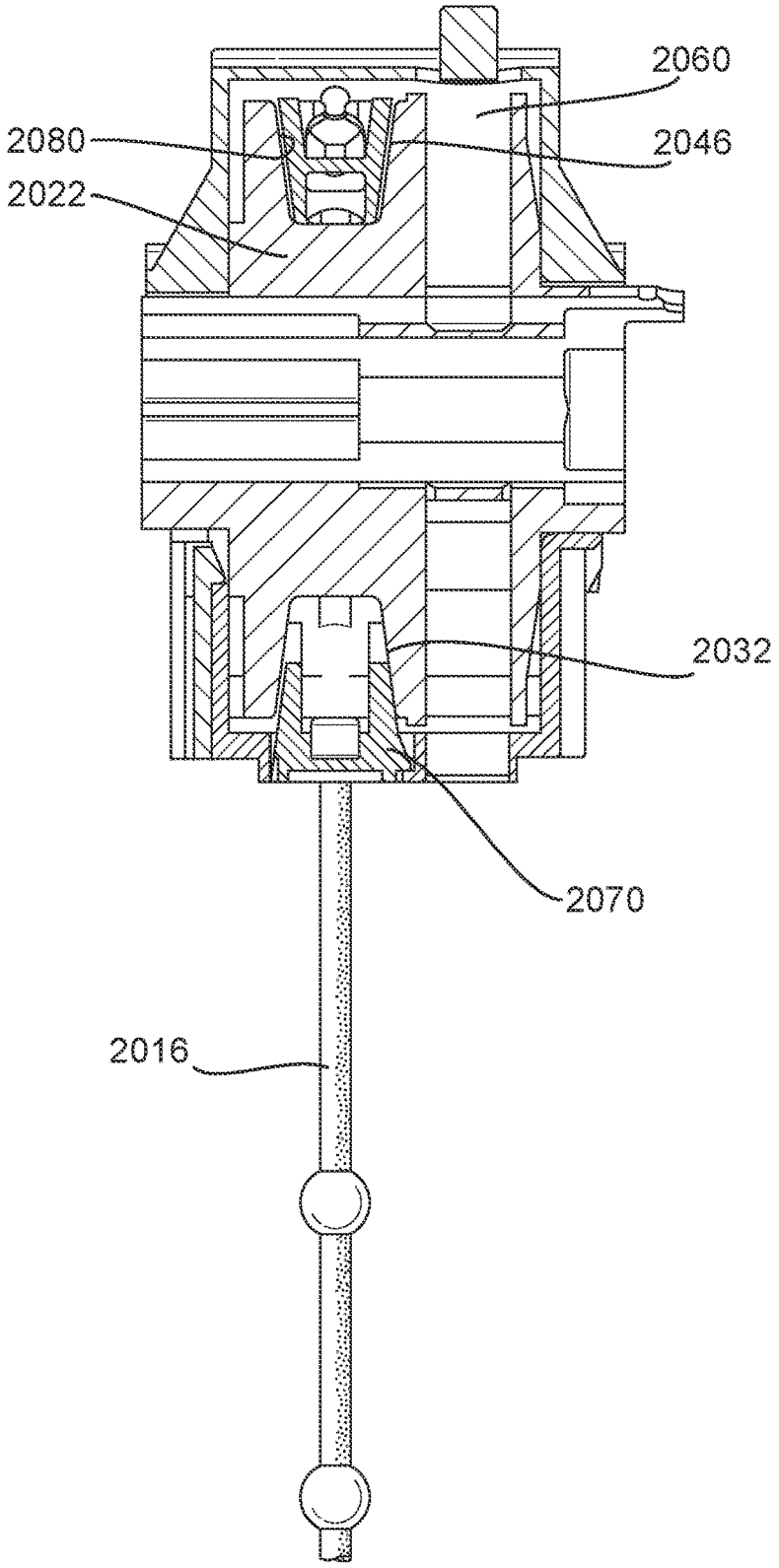

FIG. 14 illustrates a cross-section through the assembly of FIG. 12 and shows a cross-section of the tapered groove

2030 having a width, in an axial direction that is wider at a radially outward position and narrower at a radially inward position. The groove defines mutually facing and slanting side walls 2032.

As illustrated, a support wedge 2040 is provided at an upper portion of the tilt controller fitting at least partly within the tapered groove 2030 of the tape spool 2022.

The support wedge 2040 has opposite ends 2042 and 2044 and extends between those ends in an arcuate shape matching the tapered groove 30 of the tape spool 2022. As illustrated in FIG. 14, the support wedge 2040 has a cross-section matching the cross-section of the tapered groove 2030. In particular, it has opposite side walls 2046, which are angled so as to match the side walls 2032 of the tapered groove 2030. In this way, the support wedge has an arcuate extent fitting within the tapered groove 2030. It is also configured so as to provide frictional engagement with the side walls 2032 of the tapered groove 2030.

Each respective side wall 2046 of the support wedge 2040 may be provided with dedicated frictional surfaces. In this respect, although a single continuous frictional surface may be provided on each side wall 2046, as illustrated, a discrete frictional surface 2048*a*, 2048*b* is provided towards each respective end 2042, 2044 of the support wedge 2040.

As illustrated, the flexible support 2016 is connected to the support wedge and extends from the support wedge around either side of the tape spool 2022. A connection 2050 is provided for connecting the flexible support 2016 to the support wedge 2040. This connection 2050 may be of any known or convenient type. The illustrated flexible support 2016 includes respective ends 2016*a*, 2016*b*, which meet at the connection 2050. However, it is also possible for the flexible support 16 to be continuous through the connection 2050.

As illustrated, each end 2016*a*, 2016*b* of the flexible support 2016 is provided with a mounting component, such as a bead or ball, which is secured permanently to the respective end 2016*a*, 2016*b* of the flexible support 2016. The illustrated connection 2050 includes respective recesses 2054, 2056 into which the mounting portions 2052 are received. In particular, the recesses 2054, 2056 securely hold the mounting portions 2052 whilst allowing the flexible support 2016 to extend from the support wedge 2040. Although illustrated with respective recesses 2054 and 2056, the connection 2050 could instead include a single recess for receiving both mounting portions 2052. The support wedge 2040 has an inner side facing the tape spool and an outer side facing away from the tape spool. In the illustrated embodiment, the connection 2050 is provided on the outer side of the support wedge 2040. This is convenient for assembly and avoids any difficulties with regard to the connection 2050 interfering with the interface between the support wedge 2040 and tapered groove 2030. Nevertheless, it is also possible for a connection to be provided on the inner side of the support wedge 2040.

Where the flexible support 2016 extends away from the connection 2050 and around the tape spool 2022, it extends at a position between the support wedge 2040 and the tape spool 2022. As illustrated, this is achieved by the provision of respective throughholes between the outer side and the inner side of the support wedge 2040. In particular, the throughholes allow the flexible support 2016 to extend from the connection 2050 at the outer side of the support wedge 2040 through the thickness of the support wedge 2040 to the bottom of the tapered groove 2030. In this way, the support wedge 2040 has a circumferential extent that extends beyond the flexible support 2016. The flexible support 2016 does not extend around the outer side of the support wedge 2040, but, instead, travels around an inner side of the support wedge 2040.

As illustrated, the throughholes from the outer side to the inner side of the support wedge 2040 are provided as complete cut-outs, which extend from the respective opposite ends of the support wedge 2040. In other words, the side walls 2046 of the support wedge 2040 extend circumferentially beyond the position at which the flexible support 2016 extends from the outer side of the support wedge 2040 to the inner side of the support wedge 2040.

By providing the throughholes as complete cut-outs or slots, it also becomes possible for the angle at which the flexible support 2016 traverses the thickness of the support wedge 2040 to vary as the tape spool 2022 and support wedge 2040 are rotated. As illustrated, the tape spool 2022 is provided with an additional circumferential groove 2060 about which a lift cord 2018 may be wound or unwound with rotation of the tape spool 2022.

The lower portion 2026 of the housing includes at least one aperture through which the flexible support 2016 extends and at least one other aperture 2062 through which a lift cord 2018 may extend.

In operation, the tilt controller operates as follows.

When the tape spool 2022 is rotated so as to wind or unwind a lift cord 2018, the support wedge 2040 is frictionally engaged with the tapered groove 2030 of the tape spool 2022. Hence, the support wedge 2040 rotates with the tape spool 2022, thereby raising the portion of the flexible support 2016 on one side, and lowering the portion of the flexible support 2016 on the other side, so as to tilt the suspended blind slats 2014.

By providing a stop for the support wedge 2040 at a particular angular position so as to prevent further rotation of the support wedge 2040, further tilting of the blind slats 2014 can be prevented. However, the tape spool 2022 can be rotated further by overcoming the frictional engagement, thereby allowing further winding or unwinding of the lift cord 2018.

Returning to the arrangement illustrated in FIGS. 1(*a*) and 1(*b*), it will be seen that a respective control mechanism 20 (including two spool drives, for example as explained above with reference to FIGS. 7 to 14) is provided towards each respective end of the head rail 4. In the arrangement of FIG. 2, the first and second spool drives 22, 24 are located adjacent one another.

A drive shaft 26, as illustrated in FIG. 2, may be provided extending axially along the head rail 4. In this respect, the axis of the drive shaft 26 may extend in the first direction X.

Arrangements are possible in which the first and second spool drives 22, 24 are rotationally linked so as to be driven together by a single drive shaft 26 in a side-by-side arrangement. However, in the illustrated arrangement, the first and second drive spools 22, 24 are located at axially displaced positions along the drive shaft 26. Both the first spool drive 22 and the second spool drive 24 illustrated in FIG. 2 may be driven by rotation of the drive shaft 26.

As noted above, a plurality of control mechanisms 20 may be provided at different respective locations along a head rail, such as the head rail 4 of FIGS. 1(*a*) and 1(*b*). The outer housings of the spool drives of all control mechanisms used within the head rail are mounted relative to the headrail, but their respective internal mechanisms may be driven by a single drive shaft 26. The first and second spool drives 22, 24 of each control mechanism 20 may be secured rotationally within the head rail. In other words, the spool drives may be mounted within the head rail in such a manner that the spool drives are unable to rotate relative to the head rail, in particular unable to rotate about any axis generally parallel to the elongate extent of the head rail. Such mounting may be achieved in any convenient manner, for example with external features of the spool drives interacting with or mating with corresponding/opposing features on the inside of the head rail. The drive shaft 26 may be rotated so as to provide simultaneous rotational drive to all of the spool drives and thereby drive and rotate appropriate parts of their respective internal mechanism, for example the spools described above with reference to known mechanisms.

Rotation of the drive shaft 26 may be achieved and controlled by means of any known manual or motor driven mechanism.

As illustrated in FIG. 2, each group 10 of elongate members of a respective control mechanism 20 is provided as part of the first spool drive 22 and the second spool drive 24. In particular, the first spool drive 22 has a first elongate member 32*a* and a second elongate member 32*b*, and the second spool drive 24 has a first elongate member 34*a* and a second elongate member 34*b*.

These elongate members 32*a*, 32*b*, 34*a*, 34*b* are configured to be operatively engaged with edges of the slats 8 to control and move those slats 8. As discussed below, this operative engagement may be direct engagement between the elongate members 32*a*, 32*b*, 34*b* and the edges of the slats 8 or via cross-rungs between the elongate members 32*a*, 32*b*, 34*a*, 34*b* supporting and engaging with the slats 8 substantially at the edges of the slats 8.

Figure 3:
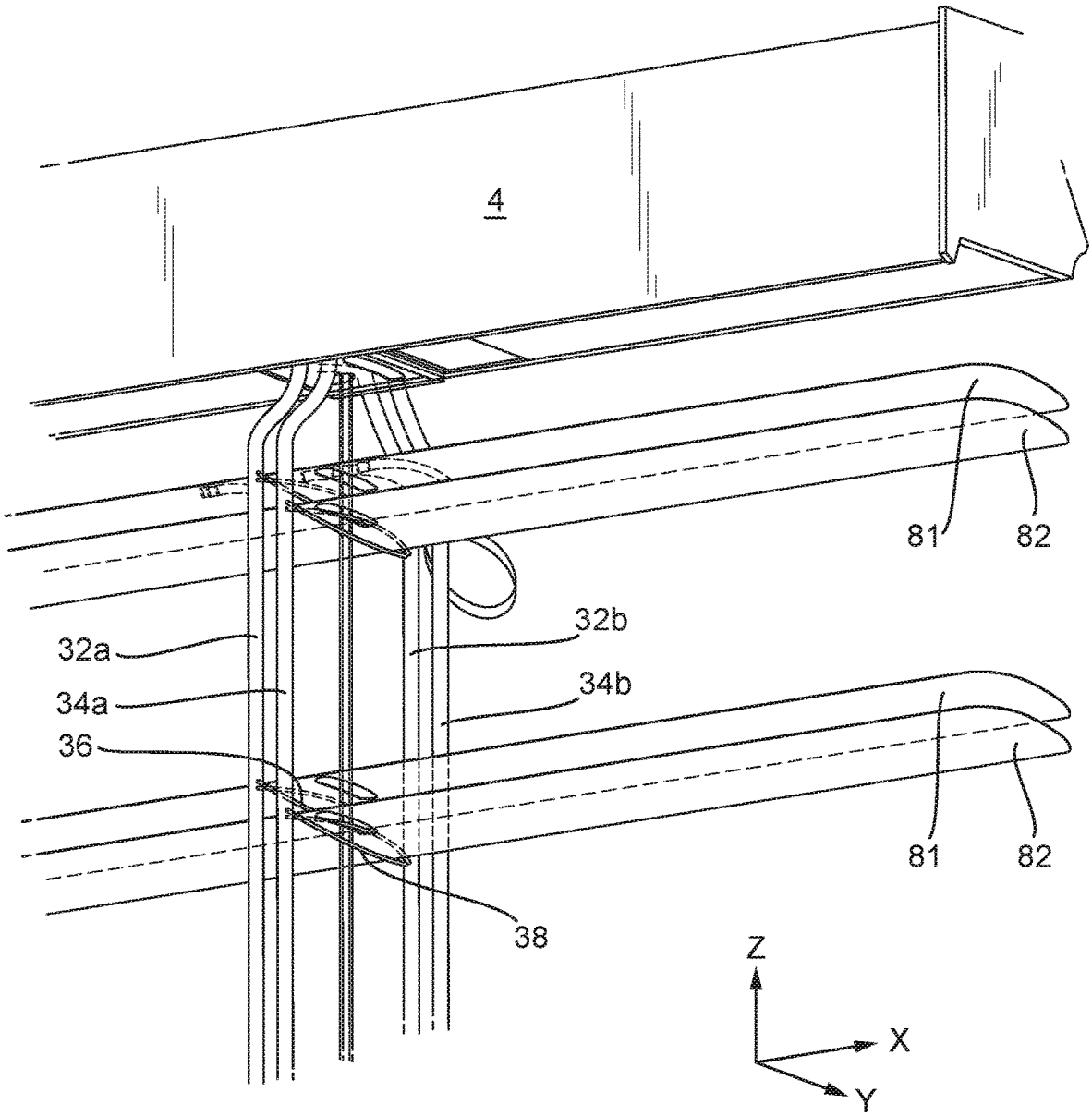
FIG. 3 illustrates engagement of the elongate members of a control mechanism with slats in an open state.

In the arrangement illustrated in FIG. 3, a plurality of cross rungs 36, 38 are provided between the elongate members 32*a*, 32*b*, 34*a*, 34*b* so as to support respective slats 8. However, arrangements are also possible where the elongate members are attached directly to the edges of the slats 8.

The configuration and operation of the first and second spool drives 22, 24 of the control mechanism 20 will now be described with reference to FIGS. 4(*a*) and (*b*). In these figures, for the purposes of explaining movement of the elongate members, the first spool drive 22 is illustrated schematically to one side of the second spool drive 24.

The elongate members 32*a*, 32*b*, 34*a*, 34*b* are configured for use with first and second sub-arrays of slats 8, the first sub-array including upper or first slats 81 and the second sub-array including lower or second slats 82. The first slats 81 of the first sub-array alternate with the second slats 82 of the second sub-array. The control mechanism is configured to bring the slats 8 into an open state, as described above with reference to FIG. 1(*a*), with pairs of slats 8 stacked in the second direction Z, each pair including a first slat 81 of the first sub-array and a second slat 82 of the second sub-array.

Figure 4A:
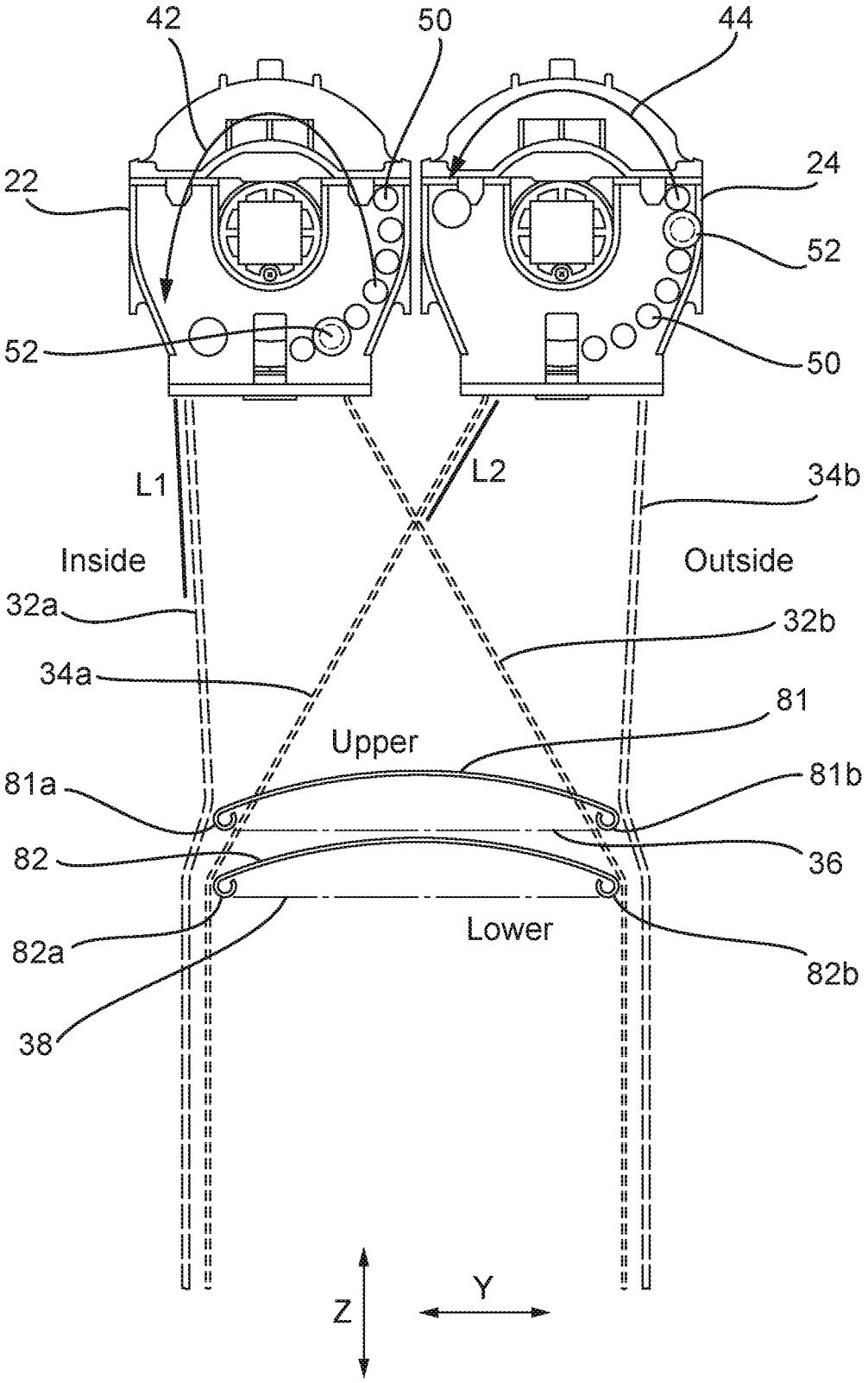
FIGS. 4(*a*) and (*b*) illustrate schematically (side-by-side) the first and second spool drives with the elongate members providing respectively the open state and closed state.
Figure 4B:
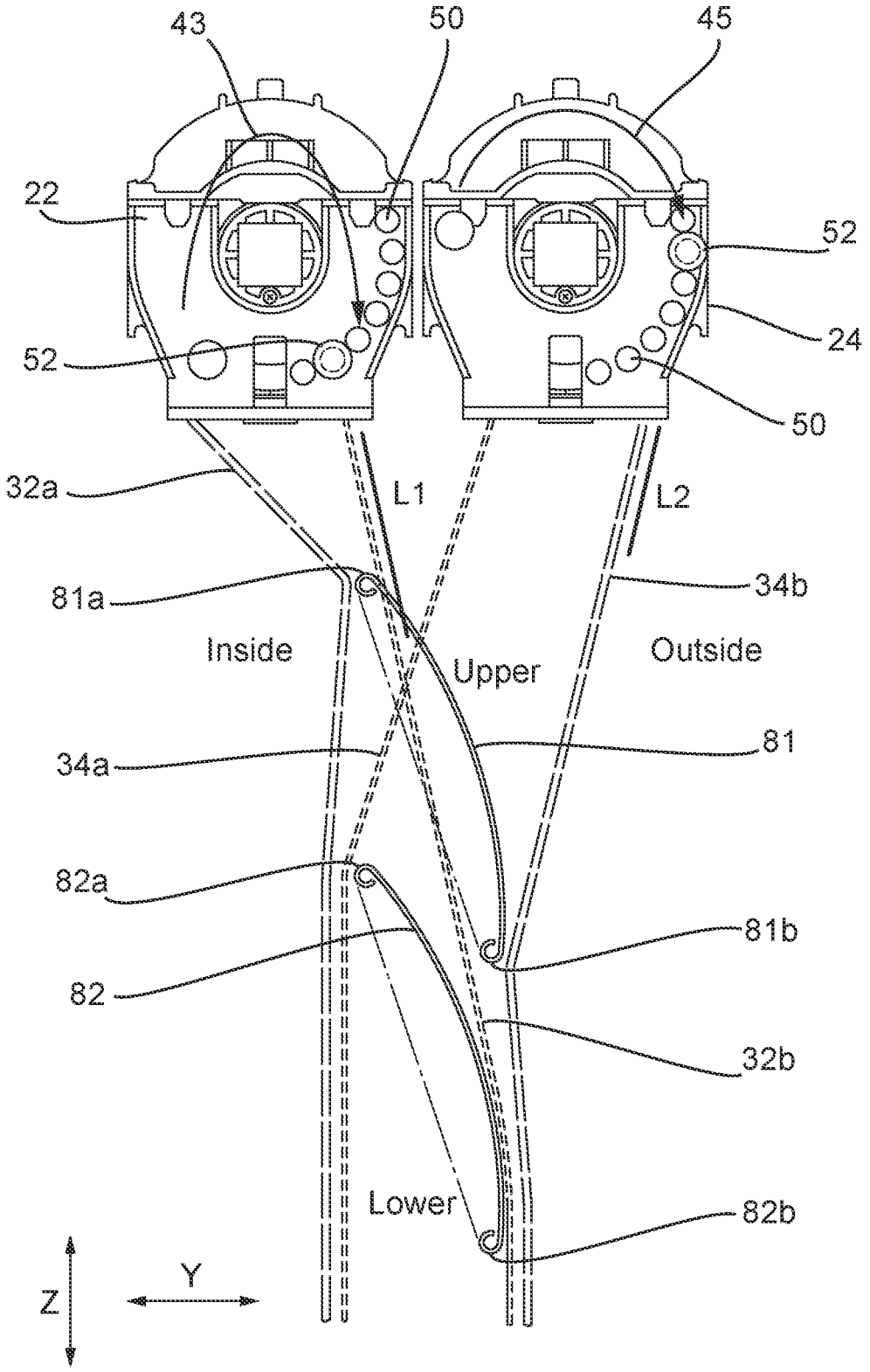

In FIGS. 4(*a*) and (*b*), only a single pair of slats 8 is considered, that pair including an upper or first slat 81 and a lower or second slat 82. FIG. 3 illustrates two such pairs arranged in an open state, one pair separated from the other pair in the second direction Z, but each pair having respective first and second slats 81, 82 stacked adjacent one another in the second direction Z.

Following on from the explanation given with reference to FIGS. 1(*a*) and (*b*), the slats 8 are stacked in the vertical or second direction Z. The array of slats 8 have first and second respective sides extending in the horizontal or third direction Y. In the illustrated embodiment, a first side may be towards the inside of the blind and the building to which it is mounted and the second side may be to the outside of the blind and the building.

As illustrated in FIGS. 4(*a*) and (*b*), an inside edge 81*a* of the upper slat 81 operatively engages the first elongate member 32*a* of the first spool drive 22. However, the opposite, outer, edge 81*b* of that upper slat 81 operatively engages the second elongate member 34*b* of the second spool drive 24. Any appropriate means of attachment may be used. For example, the edges 81*a*, 81*b* of the upper slats 81 may be coupled directly to the elongate members. However, as illustrated, a cross-rung 36 connects the first elongate member 32*a* of the first spool drive 22 with the second elongate member 34*b* of the second spool drive 24. The upper slat 81 is supported on that cross-rung 36.

In a similar manner, an inside edge 82*a* of the lower slat 82 is operatively engaged with the first elongate member 34*a* of the second spool drive 24 and the opposite outer edge 82*b* of the lower slat 82 is operatively engaged with the second elongate member 32*b* of the first spool drive 22. Also, similarly, the lower slat 82 may be attached by any appropriate means to the elongate members. For example, the edges 82*a*. 82*b* of the lower slats 82 may be coupled directly to the elongate members. However, as illustrated, a cross-rung 38 extends between the first elongate member 34*a* of the second spool drive 24 and the second elongate member 32*b* of the first spool drive 22. The lower slat 82 is supported by this cross-rung 38.

In the state illustrated in FIG. 4(*a*) rotation of the drive shaft 26 in the direction of the arrows 42 and 44 causes no operation of the elongate members 32*a*, 32*b*, 34*a*. 34*b*. In particular, the first and second spool drives 22, 24 are configured (for example in the manner of the known mechanisms described above), in this state, to allow rotation of the drive shaft 26 without transferring rotation to spooling-in or spooling-out of the elongate members 32*a*, 32*b*, 34*a*, 34*b*. However, rotation in the opposite direction, namely in the direction of arrows 43 and 45 in FIG. 4(*b*), causes spooling-in and spooling-out. This may be achieved in any appropriate manner, for example in the manner of the known mechanisms described above.

In this arrangement, when the drive shaft 26 provides rotational drive to the first spool drive 22 (in the direction 43 illustrated in FIG. 4(*b*)), the first elongate member 32*a* is spooled-in at the same rate as the second elongate member 32*b* is spooled-out. In this respect, the first elongate member 32*a* and the second elongate member 32*b* may be formed from a continuous elongate member which rotates with a spool within the first spool drive 22. The continuous elongate member should not move relative to the spool in a circumferential direction. Where the continuous elongate member takes the form of a chain, that claim may engage with one or more radial features of the spool preventing relative circumferential movement. Otherwise, the continuous elongate member and spool may engage with each other by frictional engagement or the continuous elongate member may be secured against relative movement with respect to the periphery of the spool at a midpoint between the opposite extents of spooling out.

Similarly, when the drive shaft 26 provides rotational drive to the second spool drive 24 (in the direction 45 illustrated in FIG. 4(*b*)), the first elongate member 34*a* is spooled-in and the second elongate member 34*b* is spooled-out. In the same way as described for the first spool drive 22, the first elongate member 34*a* and the second elongate member 34*b* may spool-in and spool-out at the same rate and may be provided as a single elongate member extending around a spool within the second spool drive 24.

Thus, as the drive shaft 26 provides rotational drive simultaneously to both the first spool drive 22 and the second spool drive 24, the edge 81*a* of the upper slat 81 on the first side is spooled-in (and raised as illustrated) at the same rate as the edge 82*b* of the lower slat 82 on the second side is lowered as illustrated. Also, the edge 82*a* of the lower slat 82 on the first side is raised as illustrated at the same rate as the edge 81*b* of the upper slat 81 at the second side is lowered. The rates of spooling-in and spooling-out for the first spool drive 22 and the second spool drive 24 could be different for example so that the first and second spool drives 22, 24 reach their respective full extents at the same time. This might be achieved, for example, by providing gearing (with a non one-to-one ratio) between the drive shaft and the spool in at least one of the spool drives. However, the rates of spooling-in and spooling-out may be the same so that all of the elongate members 32*a*, 32*b*, 34*a*, 34*b* spool at the same rate. This is particularly appropriate when both the first and second spool drives 22, 24 are mounted directly on, and receive direct drive from, the drive shaft 26.

Of importance to this arrangement is the feature that the extent of rotation of the first and second spool drives 22, 24 and, hence, the amount of spooling and the lengths of elongate members extended or retracted are limited, either as a preset feature of the respective spool drives 22, 24, or set by a user/installer (as explained below). In particular, as explained above, when the spool drive has reached its full extent of rotation, it then allows rotation of the drive shaft 26 without transferring rotation to spooling-in or spooling-out. In other words, the first spool drive 22 is configured to transfer rotation of the drive shaft 26 to retract or extend the first and second elongate members 32*a*, 32*b* by a first length L1. Similarly, the second spool drive is configured to transfer rotation of the drive shaft 26 to retract or extend the first and second elongate members 34*a*, 34*b* by a second length L2. Thereafter, the first and second spool drives 22, 24 allow rotation of the drive shaft without transferring rotation to extending or retracting the elongate members. This may be achieved in any appropriate manner, for example as described above for the known mechanisms.

As illustrated in FIG. 4(*a*), the first length L1 of the first elongate member 32*a* of the first spool drive 22 to be spooled in is larger than the second length L2 of the first elongate member 34*a* of the second spool drive 24 to be spooled in. When the first length L1 of the first elongate member 32*a* of the first spool drive 22 is spooled in, then the same first length L1 of the second elongate member 32*b* of the first spool drive 22 will be spooled out. Also, when the first length L2 of the first elongate member 34*a* of the second spool drive 24 is spooled in, then the same first length L2 of the second elongate member 34*b* of the second spool drive 24 will be spooled out. As illustrated in FIG. 4(*b*), the same first length L1 of the second elongate member 32*b* of the first spool drive 22 that has been spooled-out is larger than the same second length L2 of the second elongate member 34*b* of the second spool drive 24 that has been spooled out.

Both the first spool drive 22 and the second spool drive 24 are driven and rotated simultaneously by the drive shaft 26. However, when the first elongate member 34*a* of the second spool drive 24 has been retracted by the second length L2 and the second elongate member 34*b* of the second spool drive 24 has been extended by the second length L2, the second spool drive 24 does not provide any further spooling and does not retract the first elongate member 34*a* or extend the second elongate member 34*b* by any further amount. As illustrated in FIG. 4(*b*), in this state, the edge 82*a* of the lower slat 82 on the first side has been raised by a small amount relative to the raising of the edge 81*a* of the upper slat 81 and, similarly, the edge 81*b* of the upper slat 81 on the second side has been lowered by a small amount relative to lowering of the edge 82*b* of the lower slat 82.

In contrast, the first spool drive 22 is responsive to further rotation of the drive shaft 26 and continues to transfer rotation of the drive shaft 26 to spool-in and spool-out the elongate members 32*a*, 32*b* of the first spool drive 22. In particular, the first spool drive 22 continues to transfer rotation of the drive shaft 26 to the elongate member 32*a*. 32*b* until, as illustrated in FIG. 4(*b*), the first elongate member 32*a* of the first spool drive 22 is retracted by the first length L1 and the second elongate member 32*b* of the first spool drive 22 is extended by the first length L1. Noting, as mentioned above, that the first length L is larger than the second length L2, the edge 81*a* of the upper slat 81 on the first side is thus extended up away from the edge 82*a* of the lower slat 82 on the first side. Similarly, the edge 82*b* of the second slat 82 is lowered away from the edge 81*b* of the upper slat 81 on the second side. In other words, the distance traveled by edges 81*a* and 82*b* is greater than the distance traveled by edges 82*a* and 81*b*.

As a result, as illustrated, both the upper slat 81 and the lower slat 82 are tilted, but the upper slat 81 (its edge 81*a* and its centre of gravity) is moved towards the control mechanism 20, whereas the lower slat 82 (its edge 82*b* and its centre of gravity) is moved away from the control mechanism 20.

FIGS. 4(*a*) and (*b*) illustrate just one pair of slats 81, 82. It will be appreciated that the complete array of slats 8 as illustrated in FIGS. 1(*a*) and (*b*) includes a first sub-array of upper slats 81 and a second sub-array of lower slats 82 with the upper slats 81 of the first sub-array paired with respective lower slats 82 of the second sub-array. With the respective slats of the first and second sub-arrays connected to the elongate members 32*a*, 32*b*, 34*a*, 34*b* in the manner described for the pair of slats 81, 82 illustrated in FIGS. 4(*a*) and (*b*), the control mechanism 20 thus is able to move the complete array of slats 8 between the open and closed states illustrated in FIGS. 1(*a*) and (*b*) and FIGS. 4(*a*) and (*b*). In particular, in the closed state, the slats 8 may be tilted away from the width wise orientation in the direction Y towards a closed state in which they are tilted towards the direction Z.

In order to provide a blind with a fully closed state, in that closed state, the upper and lower slats 81, 82 of the sub-arrays should overlap at least by a minimal amount. When the upper and lower slats 81, 82 are then stacked in pairs in the open state, the open space between the successive pairs of stacked upper and lower slats 81, 82 can approach twice the width of an individual slat 8.

It will be appreciated that the actual extent to which the first spool drive 22 is able to transfer rotation and the corresponding actual first length will depend upon other dimensions, such as the width of the slats 8. Similarly, the actual extent of rotation and the second length for the second spool drive 24 will depend on other dimensions, such as the width of the slats.

Although the first and second spool drive 22, 24 of the control mechanism 20 could be constructed with predetermined extents of rotation (and first and second lengths) intended for use with a particular blind, arrangements are possible where the positions at which rotation of the drive shaft no longer transfers rotation to spooling-in or spooling-out of the elongate members can be adjusted.

FIGS. 4(*a*) and (*b*) illustrate schematically providing the first and second spool drives 22, 24 with a series of holes 50 into which pins 52 may be inserted selectively by the user/installer. Such an arrangement may be achieved as explained above in connection with in EP 1 052 365. By inserting the pins 52 into different holes 50, it is possible to adjust the end positions for the rotational extent during which drive of the drive shaft 26 is transmitted. Thus, it will be appreciated that the first and second drive spools 22, 24 may be identical in construction, but adjusted, for example as explained above in relation to EP 1 052 365 and WO 2012/095424, to achieve the different extents of rotation and, hence, the different first and second lengths as required for the installation.

It is possible to achieve the transmission of drive by the drive shaft 26 in the first and second spool drives 22, 24 by using a releasable clutch. In particular, the spool drive 22, 24 may be configured to release that clutch at the end of spooling of the elongate members by the appropriate length.

A stop may be incorporated in the respective spool drives 22, 24 which engages with the clutch after a predetermined amount of rotation so as to release the clutch and prevent further transmission from the drive shaft 26 to spooling-in or spooling-out. In one arrangement, the stop may be provided by the pin 52 discussed above.

Arrangements are possible where the stop at one end of rotation is fixed, but the stop at the other end may be adjusted.

As discussed above, arrangements are possible where the first and second elongate members 32*a*, 32*b*; 34*a*, 34*b* form respective single elongate members which extend around and move with a spool inside the respective spool drive 22, 24. With these arrangements, a stop, adjustable in some arrangements, acts on the spool to prevent further rotation. A releasable friction clutch may release drive between the drive shaft 26 and the spool when the spool reaches the stop.

An alternative arrangement may make use of a modification of the spool drive arrangement described in WO 2012/095424.

Figure 5A:
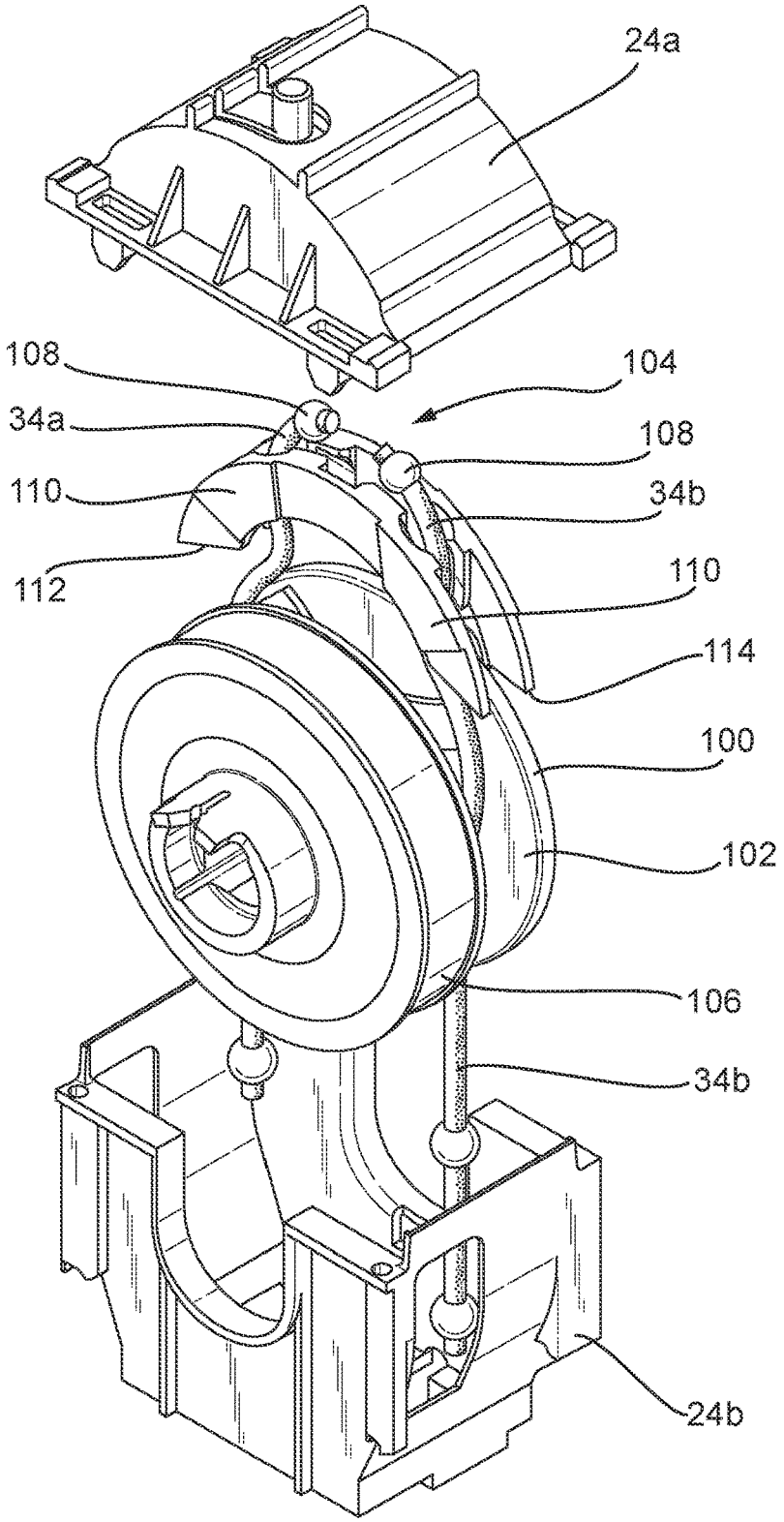
FIGS. 5(*a*) and (*b*) illustrate second and first spool drives with different support wedge lengths.
Figure 5B:
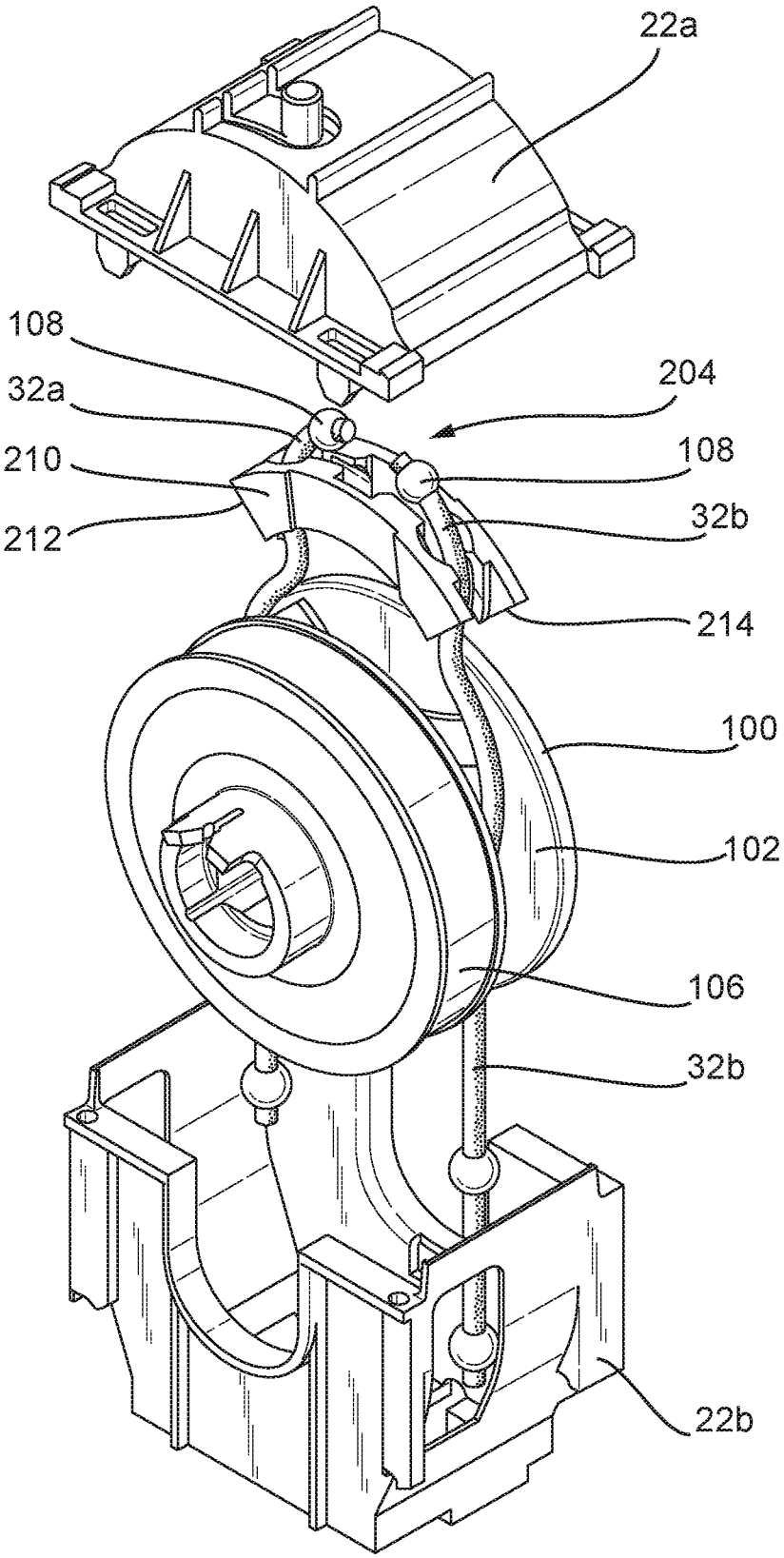

FIG. 5(*a*) illustrates a spool drive, such as the second spool drive 24 with an exploded view of its constituent parts. As illustrated, the spool drive 24 has a housing formed of an upper portion 24*a* and a lower portion 24*b*. Internally, a spool 100 is supported for rotation about its axis. In the same manner as described in WO 2012/095424, the spool 100 includes a tapered groove 102 for receiving a support wedge 104. Optionally, the spool 100 may additionally include a circumferential groove 106 about which a lift cord (not illustrated) may be wound or unwound with rotation of the spool 100. In particular, when the spool drive 24 reaches the end of its rotation for tilting the blinds 8, further rotation of the spool 100 may result in the lift cord being wound onto or unwound from the circumferential groove 106 to lift or lower the blinds.

As illustrated, the first and second elongate members 34*a*, 34*b* of the second spool drive 24 are attached to the support wedge 104. In the illustrated arrangement, the ends of the elongate members 34*a*, 34*b* include beads 108 for securing, in other words, anchoring or otherwise coupling, the ends of the elongate members 34*a*. 34*b* to the support wedge 104. Of course, any other suitable feature may be provided for securing, anchoring or coupling the ends of the elongate members 34*a*, 36*b* to the support wedge 104. Indeed, it is also possible for the first and second elongate member 34*a*. 34*b* to be formed from a continuous elongate member that passes through, but is secured, anchored or coupled to, the support wedge 104.

In the illustrated arrangement, so as to achieve the frictional benefits described in WO 2012/095424, the elongate members 34*a*, 34*b* are secured, anchored or coupled towards the outside of the support wedge 104, but pass to the inside of the support wedge 104 so as to pass around the tapered groove 102 of the spool 100. However, arrangements are also possible where the elongate members 34*a*. 34*b* are attached, anchored or coupled to the inside of the support wedge 104 or are attached, anchored or coupled to the outside, but then pass around the outside, rather than the inside.

Also in the illustrated arrangement, the support wedge 104 includes discrete fictional surfaces 110 towards each respective end 112, 114 of the support wedge 104. As described in WO 2012/095424, arrangements are also possible with a single continuous frictional surface on each sidewall.

Within the second spool drive 24, in the lower portion 24*b* of the housing, there are provided stops 103 for engaging with the support wedge 104 to restrict rotation of the support wedge 104 rotationally with the spool 100 between rotational limits defined by those stops.

Thus, in the manner described above, the spool 100 is rotated by the drive shaft 26. The support wedge 104, as a result of its frictional engagement within the tapered groove 102, rotates with the spool 100 so as to spool-in and spool-out the elongate members 34*a*, 34*b*. When the support wedge 104 reaches a rotational extent determined by a stop within the spool drive 24, further rotation is prevented and no further spooling-in or spooling-out occurs. Instead, the spool 100 is able to rotate and slip relative to the support wedge 104.

According to WO 2012/095424, the stops within the spool drive are provided by two opposite ends of a tilt stop mounted within the lower portion 24*b*. By providing different respective tilt stops having different circumferential lengths, thereby defining different positions for stops, the maximum rotational extents of the support wedge 104 can be adjusted for different spool drives. In other words, different tilt stops will provide for different amounts of spooling-in and spooling-out and different lengths by which the elongate members 34*a*, 34*b* may be retracted or extended.

Here, it is proposed not to provide different tilt stops. Instead, it is proposed to provide support wedges 104 of different lengths.

Referring to FIG. 5(*b*), the corresponding first spool drive 22 is illustrated. Actually, although different reference signs are used to signify an illustration of the first spool drive 22, apart from the support wedge 204 illustrated in FIG. 5(*b*), all of the components may be identical in construction to the components of the second spool drive 24 described with reference to FIG. 5(*a*).

As illustrated, in the arrangement of FIG. 5(*b*) the support wedge 204 is shorter in circumferential length than the support wedge 104 described with reference to FIG. 5(*a*). Thus, when used with the same stops within the lower portion 22*b* of the first spool drive 22 as the stops within the lower portion 24*b* of the second spool drive 24, the support wedge 204 is able to rotate with the spool 100 around a larger rotational extent. As a result, the arrangement will spool-in and spool-out a greater length of first and second elongate members 32*a*, 32*b*.

As illustrated, frictional surfaces 210 are provided towards each respective end 212, 214 of the support wedge 204. However, as described above, a single continuous frictional surface could be provided on each sidewall of the support wedge 204.

Figure 6A:
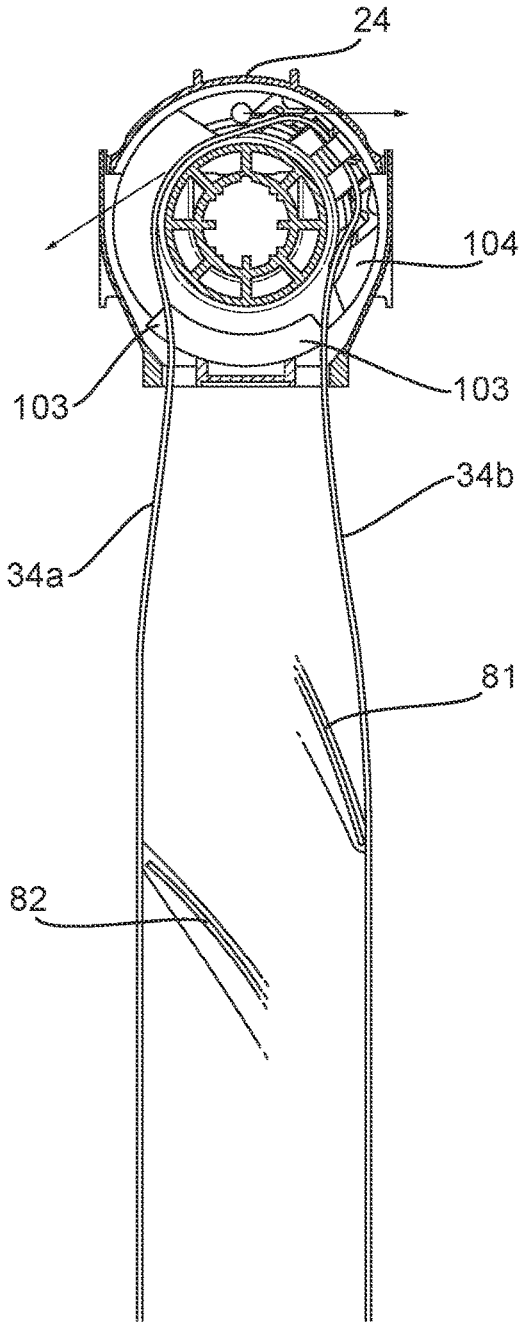
FIGS. 6(*a*) and (*b*) illustrate operation of the second and first spool drives of FIGS. 5(*a*) and (*b*)
Figure 6B:
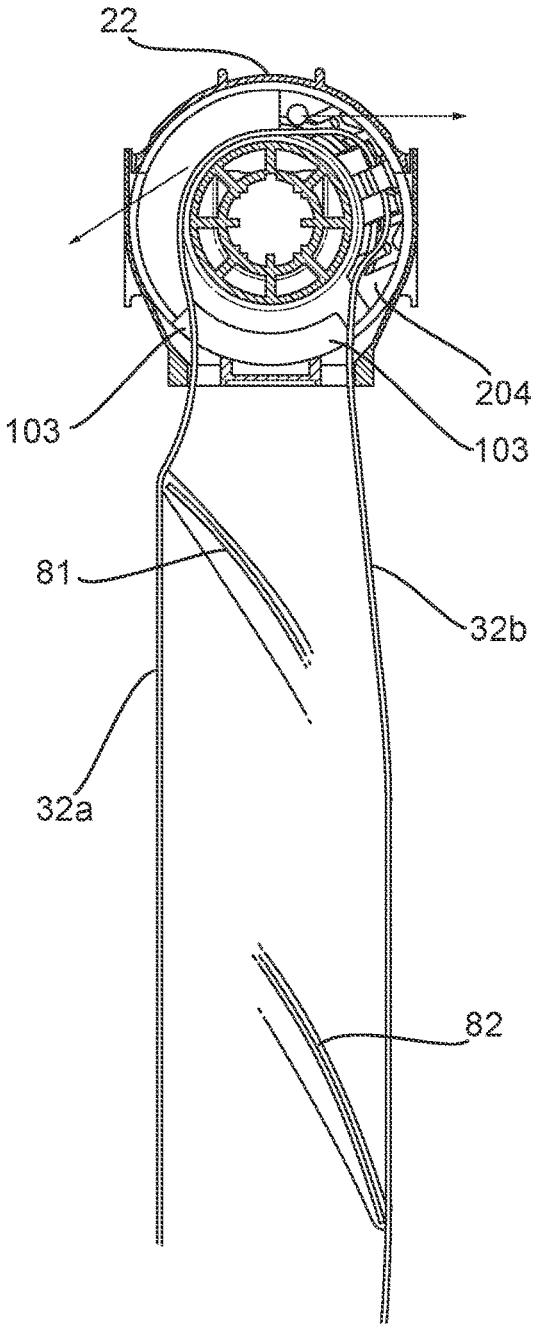

Operation of the second spool drive 24 and the first spool drive 22 according to this arrangement is illustrated respectively in FIGS. 6(*a*) and (*b*). As can be seen in these figures, by using a shorter support wedge 204 in the first spool drive 22 than the support wedge 104 in the second spool drive 24, the first spool drive 22 is able to spool-in and spool-out a greater length of first and second elongate members 32*a*, 32*b*, before the support wedge 204 prevents further spooling-in and spooling-out.

In the foregoing description, it will be appreciated that the phrases "at least one", "one or more", and "and/or", as used herein, are open-ended expressions that are both conjunctive and disjunctive in operation. The term "a" or "an" entity, as used herein, refers to one or more of that entity. As such, the terms "a" (or "an"), "one or more" and "at least one" can be used interchangeably herein. All directional references (e.g., proximal, distal, upper, lower, upward, downward, left, right, lateral, longitudinal, front, back top, bottom, above, below, vertical, horizontal, radial, axial, clockwise, counterclockwise, and/or the like) are only used for identification purposes to aid the reader's understanding of the present disclosure, and/or serve to distinguish regions of the associated elements from one another, and do not limit the associated element, particularly as to the position, orientation, or use of this disclosure. Connection references (e.g., attached, coupled, connected, and joined) are to be construed broadly and may include intermediate members between a collection of elements and relative movement between elements unless otherwise indicated. As such, connection references do not necessarily infer that two elements are directly connected and in fixed relation to each other. Identification references (e.g., primary, secondary, first, second, third, fourth, etc.) are not intended to connote importance or priority, but are used to distinguish one feature from another.

It is to be understood by one of ordinary skill in the art that the present discussion is a description of exemplary embodiments only, and is not intended as limiting the broader aspects of the present disclosure.

In the claims, the term "comprises/comprising" does not exclude the presence of other elements or steps. Furthermore, although individually listed, a plurality of means, elements or method steps may be implemented by, e.g., a single unit or processor. Additionally, although individual features may be included in different claims, these may possibly advantageously be combined, and the inclusion in different claims does not imply that a combination of features is not feasible and/or advantageous. In addition, singular references do not exclude a plurality. The terms "a", "an", "first", "second", etc., do not preclude a plurality. Reference signs in the claims are provided merely as a clarifying example and shall not be construed as limiting the scope of the claims in any way.

The invention claimed is:

1. A control mechanism for a double pitch blind comprising:

an array of tiltable slats having a first sub-array of tiltable first slats and a second sub-array of tiltable second slats, the first slats of the first sub-array alternating with the second slats of the second sub-array, and the first and second slats having respective lengths extending in a first direction, being stackable in a second direction perpendicular to the first direction and having respective widths extending between opposing respective edges respectively at first and second sides of the array of tiltable slats, the first and second sides of the array of tiltable slats being opposed in a third direction perpendicular to the first and second directions; and a control mechanism including a first spool drive and a second spool drive, both the first spool drive and the second spool drive being configured to be rotated by a single common drive shaft;

wherein:

the first spool drive has a first elongate member extendable and retractable on the first side and a second elongate member extendable and retractable on the second side;

the second spool drive has a first elongate member extendable and retractable on the first side and a second elongate member extendable and retractable on the second side;

the first elongate member of the first spool drive is configured to operatively engage with the edges of the first slats at the first side and the second elongate member of the first spool drive is configured to operatively engage with the edges of the second slats at the second side;

the first elongate member of the second spool drive is configured to operatively engage with the edges of the second slats at the first side and the second elongate member of the second spool drive is configured to operatively engage with the edges of the first slats at the second side;

the first spool drive is configured to transfer rotation of the drive shaft in one direction to spool-in and so retract the respective first elongate member and to spool-out and so extend the respective second elongate member by a first length, and to transfer rotation of the drive shaft in the other, opposite, direction to spool-out and so extend the respective first elongate member and to spool-in and so retract the respective second elongate member by the first length, and, thereafter, to allow rotation of the drive shaft without transferring rotation of the drive shaft to spooling-in or spooling-out of the first and second elongate members of the first spool drive;

the second spool drive is configured to transfer rotation of the drive shaft in one direction to spool-in and so retract the respective first elongate member and to spool-out and so extend the respective second elongate member by a second length, and to transfer rotation of the drive shaft in the other, opposite, direction to spool-out and so extend the respective first elongate member and to spool-in and so retract the respective second elongate member by the second length, and, thereafter, to allow rotation of the drive shaft without transferring rotation of the drive shaft to spooling-in or spooling-out of the first and second elongate members of the second spool drive;

the first and second slats are movable between an open state and a closed state as the first and second spools drives are rotationally driven by the drive shaft across first and second rotational extents, respectively;

the first rotational extent is larger than the second rotational extent such that the first length is larger than the second length; and when moving the first and second slats from the open state to the closed state, the drive shaft initially rotationally drives both the first spool drive and the second spool drive simultaneously until the second spool drive has been rotated fully across the second rotational extent and then rotationally drives the first spool drive relative to the second spool drive across a remainder of the first rotational extent.

2. The double pitch blind according to claim 1, wherein spooling-in of the first elongate members and spooling-out of the second elongate members is operable, when operably engaged with the edges of the first and second slats, to move the first and second slats from:

the open state in which the first and second slats extend in the third direction and are arranged in pairs of first and second slats with each respective second slat immediately adjacent the respective first slat of the respective pair; to:

the closed slate in which the first and second slats are tilted with respect to the second and third directions and overlap adjacent first and second slats on either side in the second direction.

3. The double pitch blind according to claim 1, wherein the first spool drive and the second spool drive are located at axially displaced positions along the drive shaft and are axially driven by the drive shaft.

4. The double pitch blind according to claim 3, wherein the axially displaced positions are adjacent one another such that the first elongate member of the first spool drive is adjacent the first elongate member of the second spool drive and the second elongate member of the first spool drive is adjacent the second elongate member of the second spool drive.

5. The double pitch blind according to claim 1, wherein, with reference to angular displacement of the drive shaft, the rate of spooling-in and spooling-out for the first spool drive is the same as the rate of spooling-in and spooling-out for the second spool drive.

6. The double pitch blind according to claim 1, wherein the first spool drive includes a releasable first clutch configured to transmit rotation of the drive shaft respectively to spool-in and spool-out the first and second elongate members of the first spool drive and the first spool drive is configured to release the first clutch at the end of spooling the first and second elongate members of the first spool drive by said first length with rotation of the first spool drive across the first rotational extent; and wherein the second spool drive includes a releasable second clutch configured to transmit rotation of the drive shaft respectively to spool-in and spool-out the first and second elongate members of the second spool drive and the second spool drive is configured to release the second clutch at the end of spooling the first and second elongate members of the second spool drive by said second length with rotation of the second spool drive across the second rotational extent.

7. The double pitch blind according to claim 6, wherein the first spool drive includes a first stop configured to engage with the first clutch so as to release the first clutch once the first spool drive has been rotated across the first rotational extent; and wherein the second spool drive incudes a second stop configured to engage with the second clutch so as to release the second clutch once the second spool drive has been rotated across the second rotational extent.

8. The double pitch blind according to claim 7, wherein the position of the first stop is adjustable so that said first length can be adjusted; and the position of the second stop is adjustable so that said second length can be adjusted.

9. The double pitch blind according to claim 1, wherein the first spool drive includes a first spool rotatable about an axis in the first direction and the first and second elongate members of the first spool drive together form a single elongate member extending around the first spool; and wherein the second spool drive includes a second spool rotatable about an axis in the first direction and the first and second elongate members of the second spool drive together form a single elongate member extending around the second spool.

10. The double pitch blind according to claim 1, wherein the first spool drive includes a first spool rotatable about an axis in the first direction and the first and second elongate members of the first spool drive together form a single elongate member extending around the first spool; wherein the second spool drive includes a second spool rotatable about an axis in the first direction and the first and second elongate members of the second spool drive together form a single elongate member extending around the second spool; wherein the first spool drive includes a first stop configured to engage with the first spool once the first spool drive has been rotated across the first rotational extent such that a first clutch of the first spool drive is then released; and wherein the second spool drive includes a second stop configured to engage with the second spool once the second spool drive has been rotated across the second rotational extent such that a second clutch of the second spool drive is released.

11. The double pitch blind according to claim 10, wherein the position of the first stop is adjustable so that said first length can be adjusted; and the position of the second stop is adjustable so that said second length can be adjusted.

12. The double pitch blind according to claim 1, further including:

a plurality of parallel cross-rungs extending at intervals between the first elongate member of the first spool drive and the second elongate member of the second spool drive so as, together, to form a first ladder for supporting the first slats in the first sub-array; and a plurality of parallel cross-rungs extending at intervals between the first elongate member of the second spool drive and the second elongate member of the first spool drive so as, together, to form a second ladder for supporting the second slats in the second sub-array.

13. The double pitch blind according to claim 12, wherein the intervals are double-pitch with respect to the width of the first and second slats.

14. The double pitch blind according to claim 1, wherein the respective edges of the first slats at the first side are coupled to the first elongate member of the first spool drive at respective intervals and the respective edges of the first slats at the second side are coupled to the second elongate member of the second spool drive at respective intervals; and wherein the respective edges of the second slats at the first side are coupled to the first elongate member of the second spool drive at respective intervals and the respective edges of the second slats at the second side are coupled to the second elongate member of the first spool drive at respective intervals.

15. The double pitch blind according to claim 14, wherein the intervals are double-pitch with respect to the width of the first and second slats.

16. The double pitch blind according to claim 1, the first and second elongate members of the first and second spool drives are one of tapes or cords.

17. The double pitch blind according to claim 1, including a plurality of said control mechanisms to be spaced apart in the first direction.

18. The double pitch blind according to claim 17, wherein one of the plurality of said control mechanisms is located towards one end of the drive shaft and another of the plurality of said control mechanisms is located towards another end of the drive shaft opposite to said one end.

* * * * *